US011835895B2

(12) United States Patent
Tomiyori

(10) Patent No.: US 11,835,895 B2
(45) Date of Patent: Dec. 5, 2023

(54) FIXING DEVICE FOR CORRECTING MOVEMENT DIRECTION OF FIXING BELT BY SWINGING PRESSURE ROLLER, AND IMAGE FORMING APPARATUS PROVIDED WITH SAME

(71) Applicant: SHARP KABUSHIKI KAISHA, Sakai (JP)

(72) Inventor: Minoru Tomiyori, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/692,595

(22) Filed: Mar. 11, 2022

(65) Prior Publication Data

US 2022/0308510 A1 Sep. 29, 2022

(30) Foreign Application Priority Data

Mar. 25, 2021 (JP) ..... 2021-051060

(51) Int. Cl.
*G03G 15/20* (2006.01)

(52) U.S. Cl.
CPC ..... *G03G 15/2053* (2013.01); *G03G 15/205* (2013.01); *G03G 15/2032* (2013.01); *G03G 15/2064* (2013.01); *G03G 2215/2038* (2013.01)

(58) Field of Classification Search
CPC ..... G03G 15/2032; G03G 2215/00143; G03G 2215/0015; G03G 2215/2038; G03G 2215/2032
See application file for complete search history.

(56) References Cited

U.S. PATENT DOCUMENTS 5,305,066 A * 4/1994 Koh ..... G03G 15/2053 399/338
2006/0204265 A1 9/2006 Yoshikawa
2010/0158553 A1* 6/2010 Ueno ..... G03G 15/2064 399/329

FOREIGN PATENT DOCUMENTS

JP 2002156868 A * 5/2002 ..... G03G 15/2039
JP 2006-251488 A 9/2006

OTHER PUBLICATIONS

Translation of JP-2002156868-A (Year: 2002).*

* cited by examiner

*Primary Examiner* — Arlene Heredia
(74) *Attorney, Agent, or Firm* — ScienBiziP, P.C.

(57) ABSTRACT

A fixing device includes: a fixing belt; a facing member disposed on an inner side of the fixing belt; a pressure roller that presses against the fixing belt toward the facing member from outside to form a fixing nip area; a heat source; a non-passage area temperature measurer that measures a temperature of a sheet non-passage area; a pressure roller swinger that swings one end side of the pressure roller in a direction intersecting with a longitudinal direction of the fixing nip area; and a controller that performs meandering correction control for correcting a movement direction of the fixing belt by causing the pressure roller swinger to swing the pressure roller, and the controller has such a movement mode as to cause the pressure roller swinger to forcibly move the fixing belt in a direction away from the non-passage area temperature measurer while rotating the fixing belt.

20 Claims, 16 Drawing Sheets

FIXING DEVICE FOR CORRECTING MOVEMENT DIRECTION OF FIXING BELT BY SWINGING PRESSURE ROLLER, AND IMAGE FORMING APPARATUS PROVIDED WITH SAME

BACKGROUND OF THE INVENTION

Field of the Invention

The present invention relates to a fixing device, and an image forming apparatus provided with the same.

Description of the Background Art

As a fixing device used in an image forming apparatus, there is known a fixing device including a fixing belt, a facing member disposed on an inner side of the fixing belt, a pressure roller that presses against the fixing belt toward the facing member from the outside to form, between the fixing belt and the pressure roller, a fixing nip area for conveying a sheet formed with a toner image thereon, and a heat source that heats the fixing belt, in which the toner image is fixed to the sheet by sandwiching the sheet formed with the unfixed toner image between the fixing belt and the pressure roller and heating the sandwiched sheet. In such a fixing device, a passage area temperature measurer that measures the temperature of an area where a sheet passes (passage area) on the fixing belt in order to control the temperature of the fixing belt.

As in Japanese Unexamined Patent Application Publication No. 2006-251488, there is a fixing device further provided with a non-passage area temperature measurer that measures the temperature of an area where no sheet passes (non-passage area) on a fixing belt.

By measuring the respective temperatures of the passage area and the non-passage area on the fixing belt, it is possible to determine whether or not sheet winding of a sheet onto the fixing belt has occurred in the passage area, on the basis of the difference between these temperatures. Specifically, in a case where sheet winding occurs in the passage area, rise in the temperature measured in the passage area is prevented by the sheet, and therefore the difference between the temperature of the passage area and the temperature of the non-passage area becomes significant. On the other hand, in a case where no sheet winding occurs in the passage area, rise in the temperature measured in the passage area is not prevented, and therefore the difference between the temperature of the passage area and the temperature of the non-passage area remains small. Therefore, in a case where the difference between the temperature of the passage area and the temperature of the non-passage area is equal to or greater than a specified temperature, it is determined that the sheet winding of a sheet onto the fixing belt has occurred in the passage area.

In a case where erroneous determination of no sheet winding is made in spite of occurrence of the sheet winding, the fixing belt continues to be heated above a target temperature (fixing temperature). When the fixing belt is overheated, malfunction in the fixing device is caused, and therefore high accuracy is required to determine whether or not the sheet winding occurs.

Since a sheet can be closer to the non-passage area on the fixing belt, the sheet winding of the sheet can occur not only in the passage area but also in the non-passage area. In the conventional technology described above, in a case where sheet winding of a sheet onto the fixing belt also occurs in the non-passage area, there is a problem that erroneous determination as to whether or not the sheet winding occurs may be made.

In particular, in a case where the sheet is thin, even when the non-passage area temperature measurer is, for example, a so-called "contact-type temperature sensor" which is in contact with the fixing belt, the sheet can easily enter between the non-passage area temperature measurer and the fixing belt. The sheet interposed between the non-passage area temperature measurer and the fixing belt prevents normal temperature measurement in the non-passage area, resulting in a problem that erroneous determination as to whether or not the sheet winding occurs is caused.

However, particularly when a jam including sheet winding of a sheet occurs, the sheet that causes the jam or other sheets may remain without being properly removed. In particular, in a case where the sheet is thin, the sheet is in close contact with the fixing belt, resulting in a problem that a user overlooks the sheet winding without noticing the sheet remaining in the fixing device.

The present invention has been made to solve the above-mentioned conventional problems, and an object of the present invention is to provide a fixing device and an image forming apparatus provided with such a fixing device capable of measuring the temperature of a non-passing area of a sheet more reliably even in a case where the sheet remains on the fixing belt, and thus capable of accurately determining whether or not the sheet winding of the sheet occurs.

SUMMARY OF THE INVENTION

In order to achieve the above object, a fixing device of the present invention is a fixing device including: a rotatable endless fixing belt; a facing member disposed on an inner side of the fixing belt; a pressure roller that presses against the fixing belt toward the facing member from outside to form, between the fixing belt and the pressure roller, a fixing nip area for conveying a sheet formed with a toner image thereon; a heat source that heats the fixing belt; a non-passage area temperature measurer that measures a temperature of a sheet non-passage area which corresponds to an area where the sheet is not conveyed in the fixing nip area and is on one end side in a width direction of the fixing belt; a pressure roller swinger that swings one end side of the pressure roller in a direction intersecting with a longitudinal direction of the fixing nip area; and a controller that performs meandering correction control for correcting a movement direction of the fixing belt by causing the pressure roller swinger to swing the pressure roller, wherein the controller has such a movement mode as to cause the pressure roller swinger to forcibly move the fixing belt in a direction away from the non-passage area temperature measurer while rotating the fixing belt.

In the fixing device, the controller may execute the movement mode during return operation from a sheet jam.

In the fixing device, the movement mode may be executed while the fixing belt is rotated by a predetermined distance.

The fixing device may further have a belt edge detector that detects an edge on the other end side in the width direction of the fixing belt, and the controller may control the pressure roller swinger on the basis of a detection result of the belt edge detector.

In the fixing device, in a case where the belt edge detector detects the edge of the fixing belt when the controller starts rotating the fixing belt, the controller may execute the movement mode for a predetermined time, and thereafter shift to the meandering correction control.

In the fixing device, the controller may cause the heat source to generate heat during execution of the movement mode, and in a case where the temperature of the sheet non-passage area measured by the non-passage area temperature measurer does not rise by a predetermined value or more for a predetermined time, the controller may determine that sheet winding of a sheet onto the fixing belt has occurred.

The fixing device may further have a passage area temperature measurer that measures a temperature of a sheet passage area on the fixing belt, and the controller may cause the heat source to generate heat during execution of the movement mode, and after a predetermined time elapses, the controller may determine whether or not sheet winding of a sheet onto the fixing belt has occurred, on the basis of the temperature of the sheet non-passage area measured by the non-passage area temperature measurer and the temperature of the sheet passage area measured by the passage area temperature measurer.

In the fixing device, when the controller determines that the sheet winding has occurred, the controller may stop the heat generation of the heat source and the rotation of the fixing belt.

An image forming apparatus according to the present invention is an image forming apparatus including the fixing device.

According to the present invention, elimination of a sheet of a non-passage area is facilitated, and therefore it is possible to more reliably measure the temperature of the non-passage area, and whether or not sheet winding of a sheet onto a fixing belt can be determined with higher accuracy on the basis of the temperature of the non-passage area.

DESCRIPTION OF THE PREFERRED EMBODIMENTS

Figure 1:
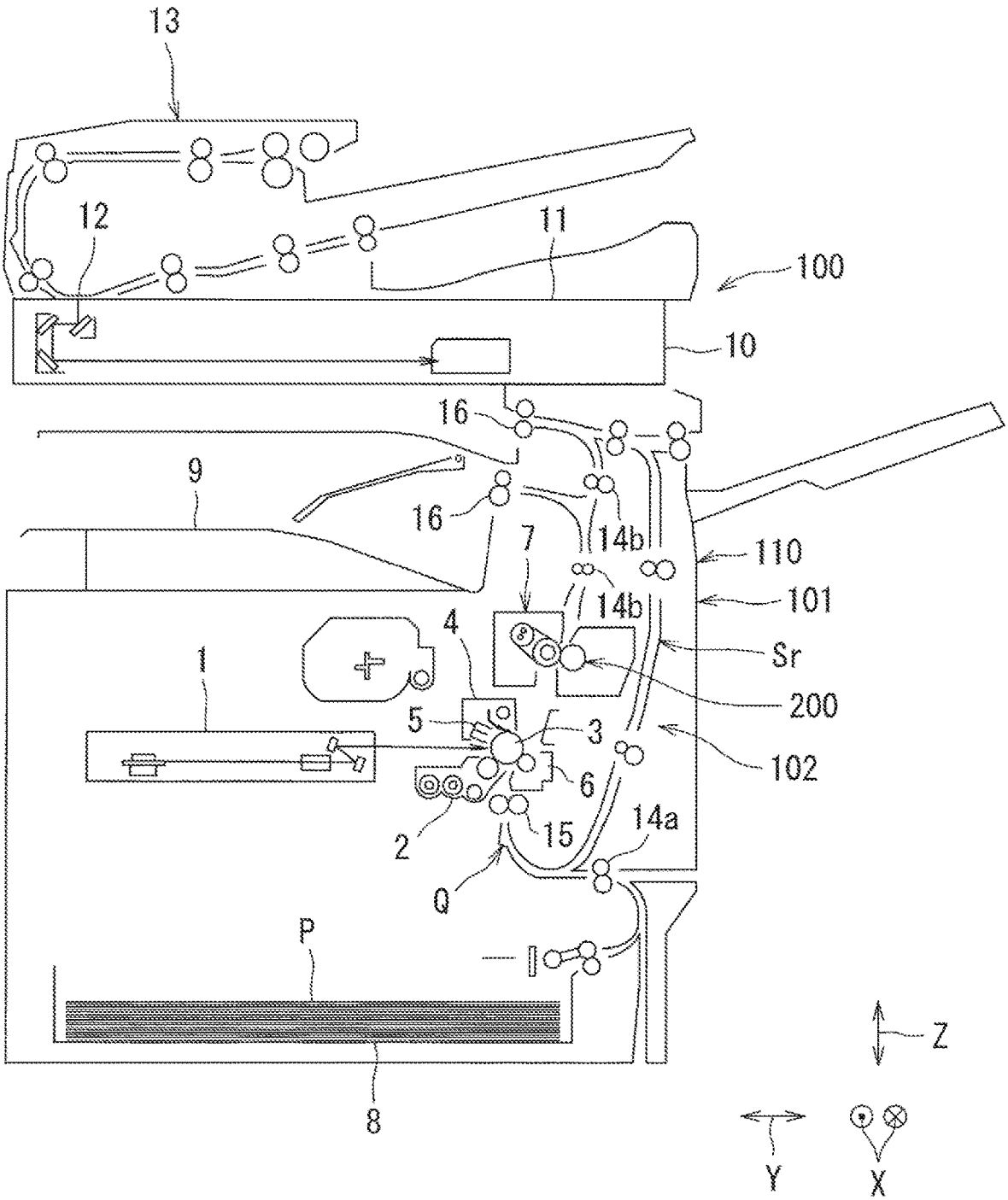
FIG. 1 is a schematic sectional view of an image forming apparatus provided with a fixing device in Embodiment 1, viewed from the front.

Hereinafter, embodiments of the present invention will be described with reference to the accompanying drawings. In the following description, the same parts and the like are denoted by the same reference numerals, as well as names and functions thereof are the same. Therefore, detailed description of those parts and the like will be omitted.

Embodiment 1

—Overall Configuration of Image Forming Apparatus—

FIG. 1 is a schematic sectional view of an image forming apparatus 100 provided with a fixing device 200 in Embodiment 1, viewed from the front. In FIG. 1, a reference character X indicates the width direction (depth direction), in which the −X direction (minus X direction) is defined as the front direction and the +X direction (plus X direction) is defined as the rear direction. A reference character Y indicates the left and right direction orthogonal to the width direction X, in which the −Y direction (minus Y direction) is defined as the left direction and the +Y direction (plus Y direction) is defined as the right direction. A reference character Z indicates an up and down direction, in which the −Z direction (minus Z direction) is defined as the downward direction and the +Z direction (plus Z direction) is defined as the upward direction. The same applies to the figures described below.

The image forming apparatus 100 illustrated in FIG. 1 is an image forming apparatus that forms a monochrome image on a sheet P such as recording paper by an electrophotographic method, in accordance with image data read by an image reading device 10 or image data transmitted from outside. The image forming apparatus 100 may be a color image forming apparatus that forms multi-color and single-color images.

The image forming apparatus 100 includes the image reading device 10, and an image forming apparatus body 110, and the image forming apparatus body 110 is provided with an image former 101 and a sheet conveyance system 102.

The image former 101 includes an exposure device 1 (exposure unit), a developing device 2 (developing unit), the photoconductor drum 3, a photoconductor cleaning device 4, a charging device 5, a transfer device 6 (transfer unit), and the fixing device 200 (fixing unit). The sheet conveyance system 102 includes a paper feed tray 8 and a discharge tray 9.

On an upper portion of the image forming apparatus body 110, a document placement glass 11 and a document reading glass 12 are provided, and the image reading device 10 for reading an image of a document (not illustrated) is provided on a lower portion of the document placement glass 11 and the document reading glass 12. The document placement glass 11 is a document placement table on which a document is placed. A document feeder 13 is disposed on the upper side of the document placement glass 11 and the document reading glass 12. The document reading glass 12 is provided at such a position as to read a document conveyed by the document feeder 13. An image of the document read by the image reading device 10 is sent as image data to the image forming apparatus body 110, and an image formed on the basis of the image data in the image forming apparatus body 110 is formed (printed) on the sheet P.

In the image forming apparatus 100, in order to perform image formation (printing), a sheet P is supplied from the paper feed tray 8, and the sheet P is conveyed to resist rollers 15 by conveyance rollers 14*a* provided along a sheet conveyance path Q. Next, the sheet P is conveyed at a timing at which the sheet P is aligned with a toner image on a photoconductor drum 3, and the toner image on the photoconductor drum 3 is transferred onto the sheet P by the transfer device 6. After that, the fixing device 200 melts and fixes unfixed toner on the sheet P with heat, and the sheet is discharged on the discharge tray 9 through conveyance rollers 14*b* to 14*b* and discharge rollers 16, 16. In the image forming apparatus 100, in a case where image formation (printing) is performed on the back side of the sheet P as well as the front side of the sheet P, the sheet P is transported in the reverse direction from the discharge rollers 16, 16 to a reversing path Sr, the front side and the back side of the sheet P are reversed, and the sheet P is guided to the resist rollers 15 again. Similarly to the front side of the sheet P, the toner image is fixed to the back side of the sheet P, and the sheet P is discharged to the discharge tray 9. Thus, the image forming apparatus 100 completes a series of printing operation. The sheet P is conveyed along the sheet conveyance path Q with the center of the image forming apparatus body 110 as a reference (center reference) in the direction of the rotation axis of the photoconductor drum 3 (width direction X).

—Fixing Device—

Figure 2:
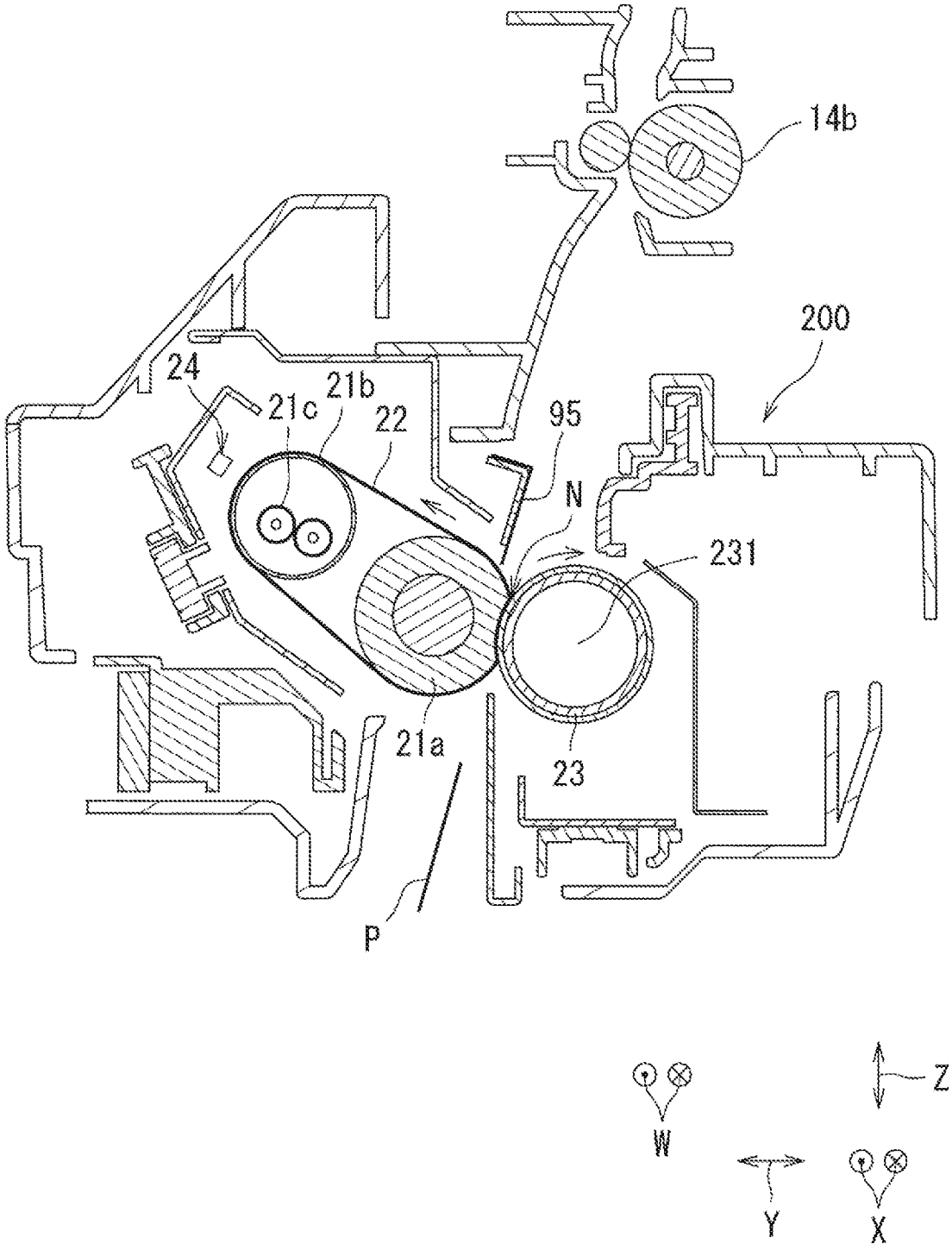
FIG. 2 is a schematic sectional view illustrating the fixing device in Embodiment 1.
Figure 3:
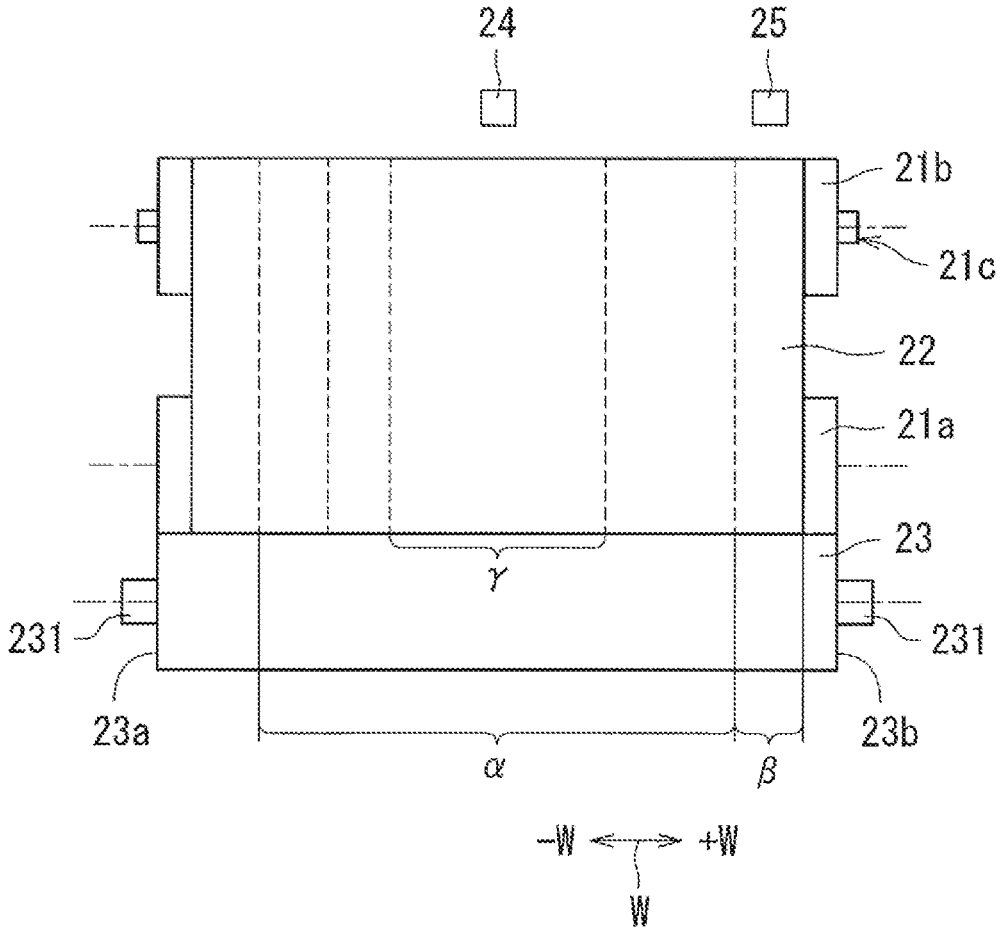
FIG. 3 is a plan view schematically illustrating a fixing belt.
Figure 4:
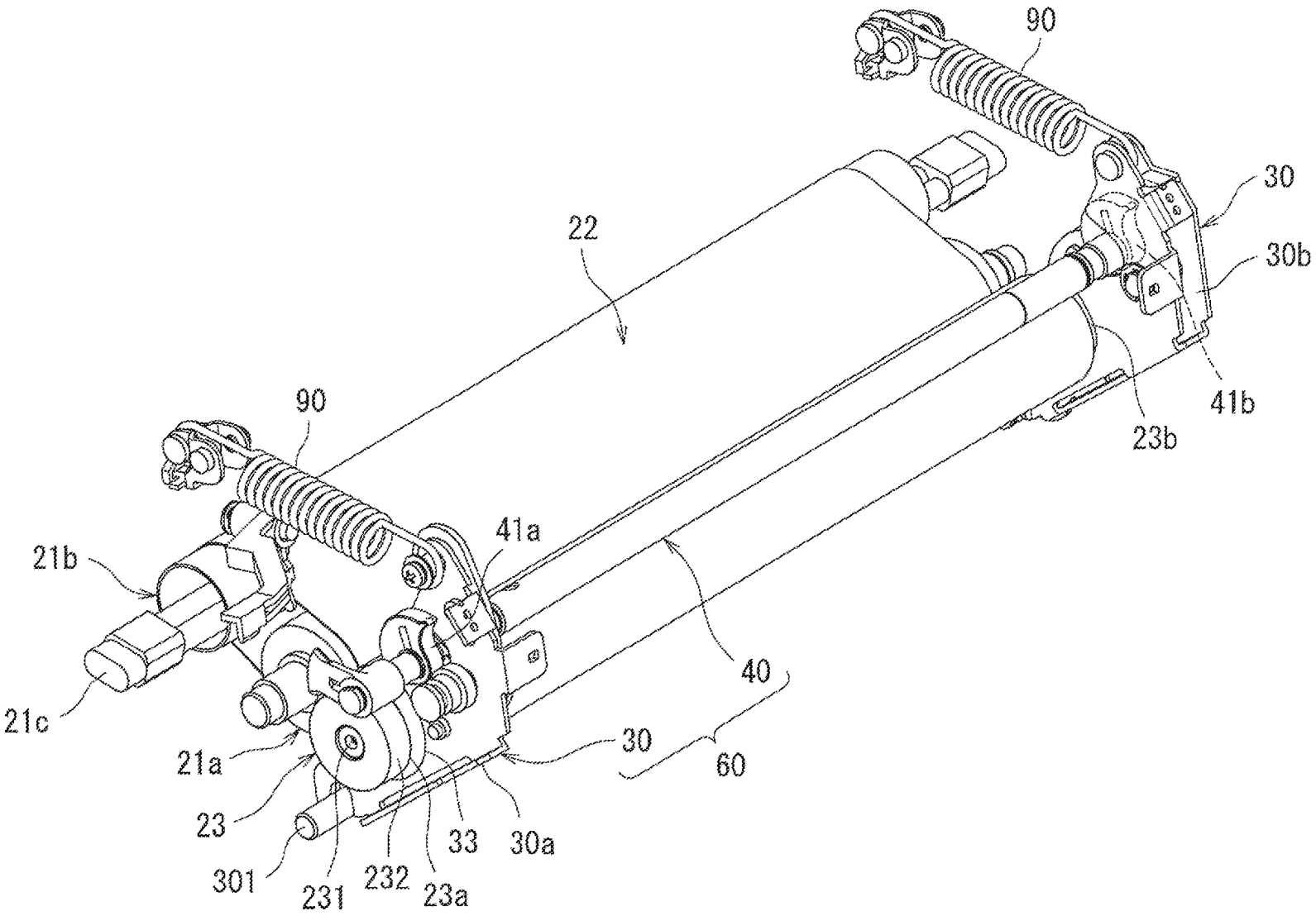
FIG. 4 is a perspective view illustrating a part of a configuration of the fixing device in Embodiment 1.

FIG. 2 is a schematic sectional view illustrating the fixing device 200 in Embodiment 1. FIG. 3 is a plan view schematically illustrating a fixing belt 22. FIG. 4 is a perspective view illustrating a part of a configuration of the fixing device 200. In the figure, a reference character W indicates the rotation axis direction of the fixing belt 22, the −W direction (minus W direction) is defined as the axis front direction, and the +W direction (plus W direction) is defined as the axis rear direction. In this embodiment, the W direction is along the X direction.

The fixing device 200 includes a fixing roller 21*a*, a heating roller 21*b*, a heat source 21*c*, a fixing belt 22, a pressure roller 23, a passage area temperature measurer 24, a non-passage area temperature measurer 25, a pressure roller swinger 60, and a controller 70. The controller 70 may be provided in the image forming apparatus 100. Hereinafter, each configuration of the fixing device 200 will be described in detail.

<Fixing Roller, Heating Roller and Heat Source>

The fixing roller 21*a* corresponds to a "facing member" described in the claim, and is disposed on the inner side of the fixing belt 22 (see FIG. 2). The fixing roller 21*a* is supported by a fixing frame (not illustrated) in a rotatable state. As the facing member, in place of the fixing roller 21*a*, a plate-like member that have a flat or curved pad on the pressure roller 23 side, and that allows the fixing belt 22 to be sandwiched between the pressure roller 23 and the member may be used.

The heating roller 21*b* incorporates the heat source 21*c* (see FIG. 2). The heat source 21*c* heats the fixing belt 22, and is formed, for example, from a lamp heater.

For example, the heat source 21*c* may be incorporated into the fixing roller 21*a*, since it is enough to heat the fixing belt 22.

<Fixing Belt>

The fixing belt 22 is an endless belt suspended rotatably on the fixing roller 21*a* and the heating roller 21*b* with the rotation axis direction as the W direction, and has a predetermined width along the W direction (see FIG. 2 and FIG. 3). The fixing belt 22 has a role of sandwiching and conveying the sheet P together with the pressure roller 23. The fixing belt 22 is heated to a predetermined temperature by the heat source 21*c* via the heating roller 21*b*, and maintained at a predetermined target temperature (fixing temperature). In this embodiment, the fixing belt 22 is rotated in conjunction with rotational drive of the pressure roller 23 described below.

A surface of the fixing belt 22 is defined by a sheet passage area α and a sheet non-passage area ß in the W direction (see FIG. 3).

The sheet passage area a is an area where the sheet P can pass and abut on the fixing belt 22 by conveyance. Specifically, the sheet passage area α is an area corresponding to an area where the sheet P is conveyed in a fixing nip area N described below, and is set to be large enough in the W direction to allow the largest sheet that can pass to pass in the direction along a long side thereof (the so-called vertical feed direction). For example, in a case where the largest sheet that can pass is an A3-size sheet, the width of the sheet passage area a is set equal to or slightly larger than a short side of the A3-size sheet (297 mm) in the W direction.

The width of the smallest sheet passage area γ within the sheet passage area a is set equal to or slightly smaller than a short side of the smallest sheet (e.g., B6 size) that can pass.

The sheet non-passage area ß is an area corresponding to an area where the sheet P is not conveyed in the fixing nip area N described below, and is an area on the +W direction end side of the fixing belt 22 (area on the +W direction side of the sheet passage area α) (see FIG. 3).

<Pressure Roller>

The pressure roller 23 presses against the fixing roller 21*a* from the outside of the fixing belt 22 to form, between the fixing belt 22 and the pressure roller 23, the fixing nip area N for conveying the sheet P formed with a toner image thereon. A rotating shaft 231 is supported by a pair of front and rear pressure frames 30 (30*a*, 30*b*) via bearings 232 (see FIG. 4). The outside (periphery) of the rotating shaft 231 is coated with an elastic material, for example, heat-resistant silicon rubber of about 5 mm. The pressure roller 23 is pressed against the fixing belt 22 by biasing force of biasing members 90 (e.g., coil springs) that are locked to the pressure frames 30. (see FIG. 4). The pressure roller 23 is rotationally driven by the roller driving unit 78 (drive motor) described below. When the pressure roller 23 is rotationally driven in a state in which the pressure roller 23 is pressed against the fixing belt 22, the fixing belt 22 pressed in the fixing nip area N is rotated.

<Passage Area Temperature Measurer>

The passage area temperature measurer 24 measures the temperature Ta of the sheet passage area α and is provided at a predetermined distance from the fixing belt 22 (see FIG. 3). In this embodiment, the passage area temperature measurer 24 measures the temperature of the smallest sheet passage area γ within the sheet passage area α. In this embodiment, the passage area temperature measurer 24 is a so-called non-contact temperature sensor.

<Non-Passage Area Temperature Measurer>

The non-passage area temperature measurer 25 measures the temperature Tß of the sheet non-passage area ß on the fixing belt 22, and has a tip provided in contact with the sheet non-passage area ß (see FIG. 3). In this embodiment, the non-passage area temperature measurer 25 is a so-called contact-type temperature sensor.

<Pressure Roller Swinger>

Figure 5:
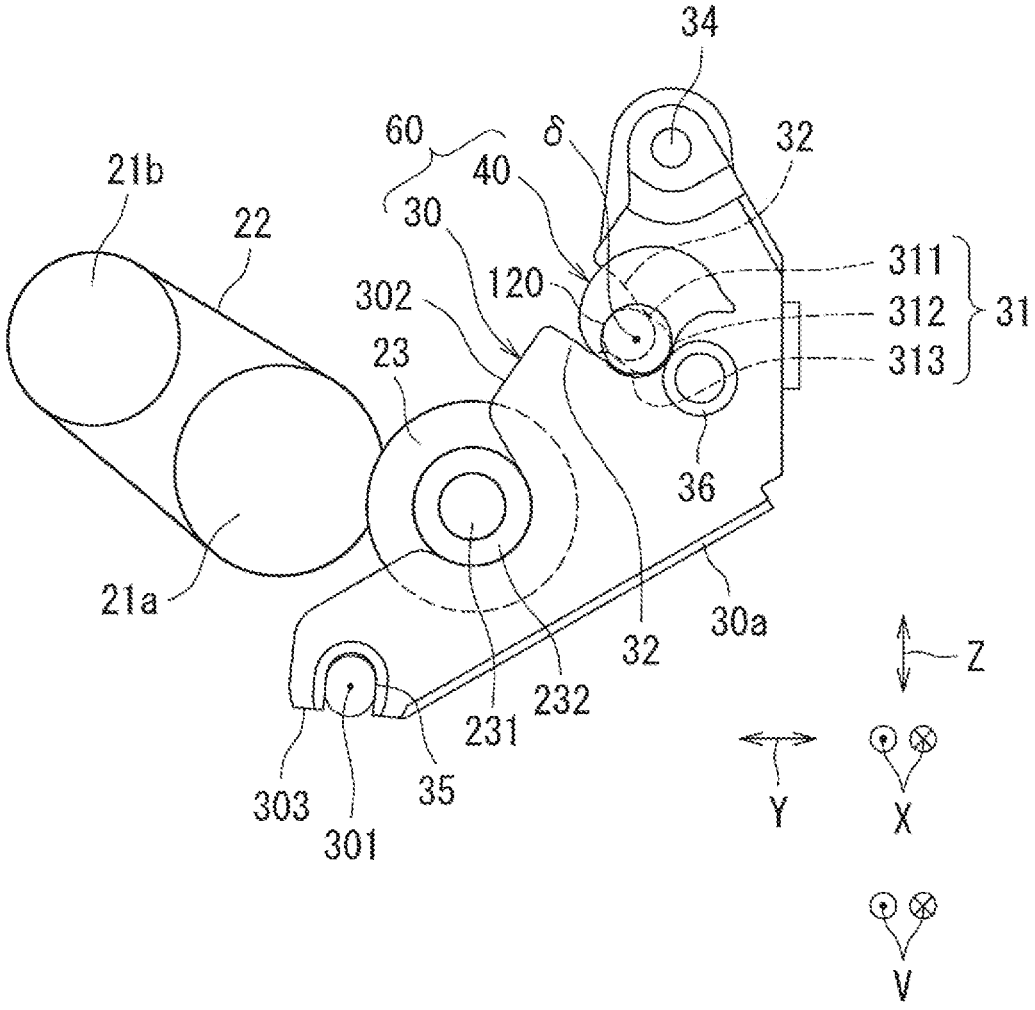
FIG. 5 is a schematic front view illustrating a configuration of a pressure roller swinger in a state in which the pressure roller presses against the fixing belt at a neutral position.
Figure 6:
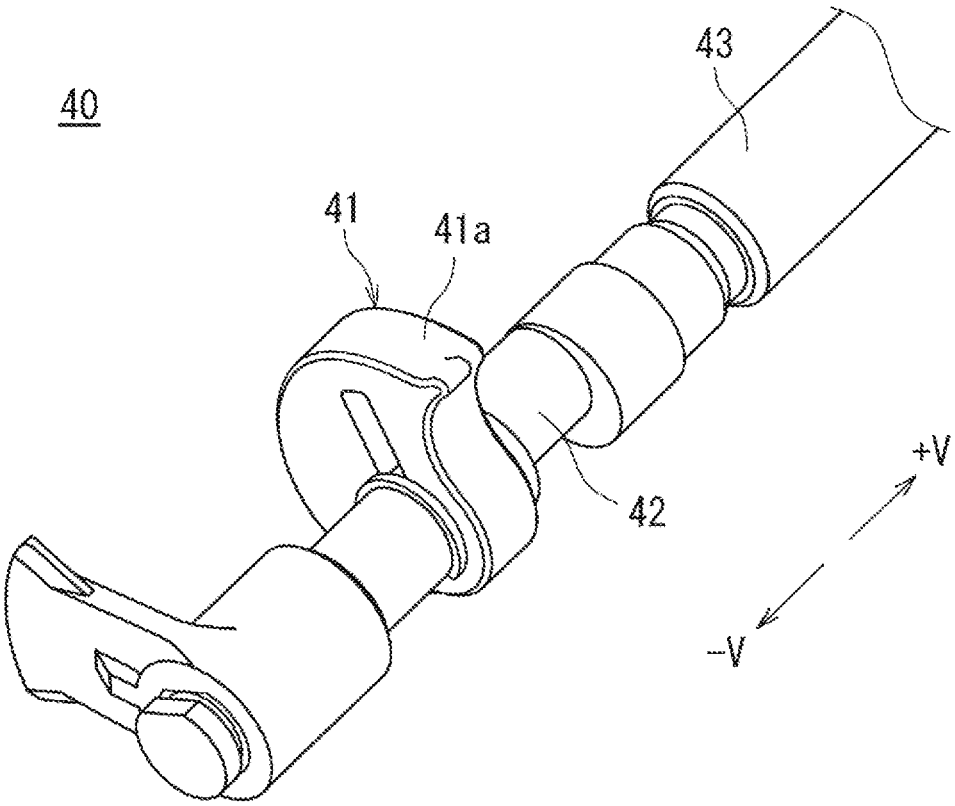
FIG. 6 is a perspective view illustrating a part of a configuration of a cam shaft.
Figure 7:
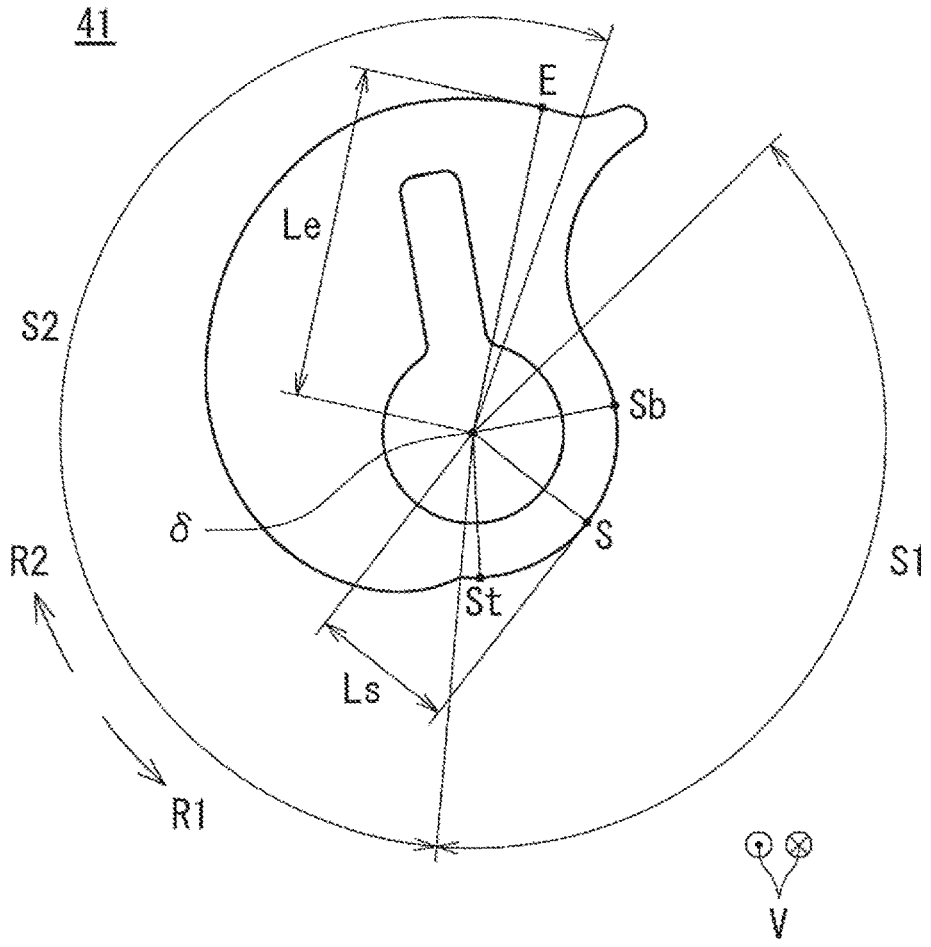
FIG. 7 is a schematic diagram of a first cam viewed from the direction of a rotation axis of a cam shaft.
Figure 8:
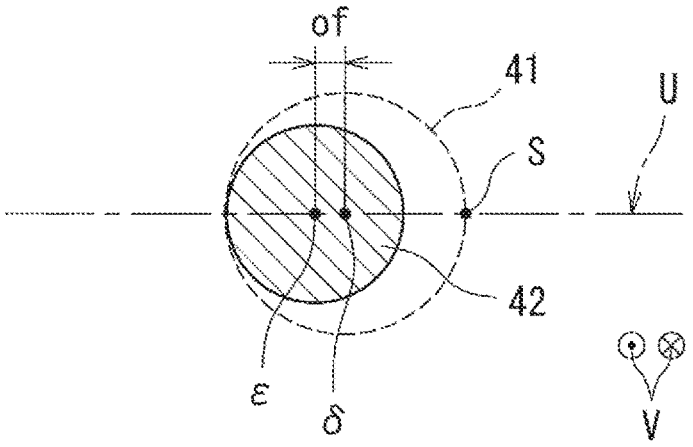
FIG. 8 is a schematic diagram of a second cam viewed from the direction of a rotation axis of a cam shaft.
Figure 9A:
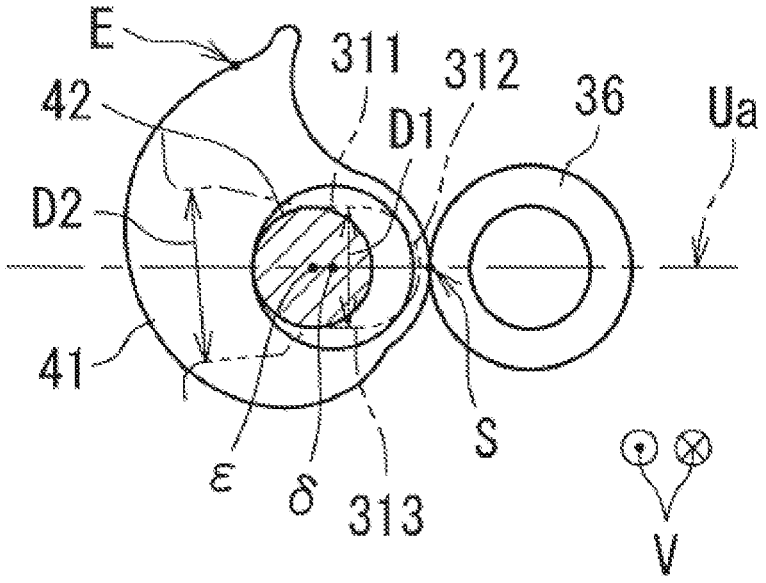
FIG. 9A is a schematic diagram illustrating positional relationship between the cam shaft and a pressure frame in a case where an abutting position of the first cam and a stopper is a position S.
Figure 9B:
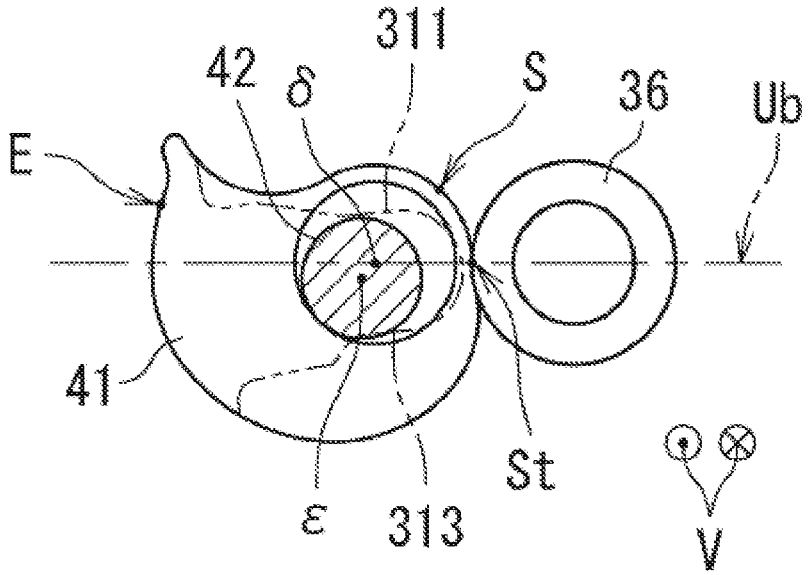
FIG. 9B is a schematic diagram illustrating positional relationship between the cam shaft and the pressure frame in a case where an abutting position of the first cam and the stopper is a position St.
Figure 9C:
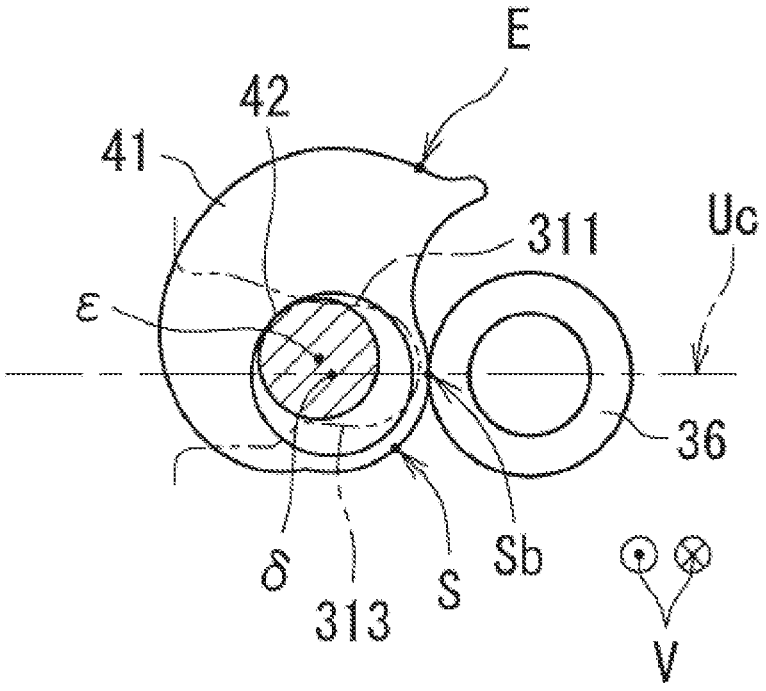
FIG. 9C is a schematic diagram illustrating positional relationship between the cam shaft and the pressure frame in a case where an abutting position of the first cam and the stopper is a position Sb.
Figure 9D:
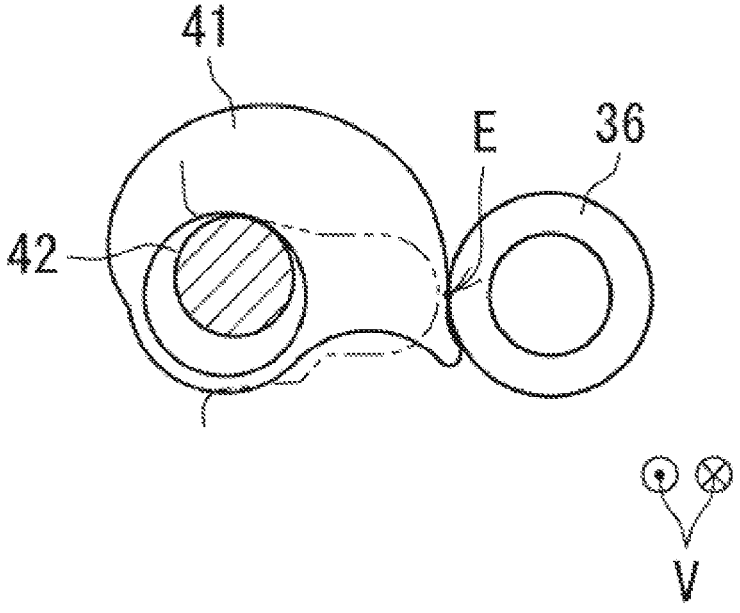
FIG. 9D is a schematic diagram illustrating positional relationship between the cam shaft and the pressure frame in a case where an abutting position of the first cam and the stopper is a position E.
Figure 10:
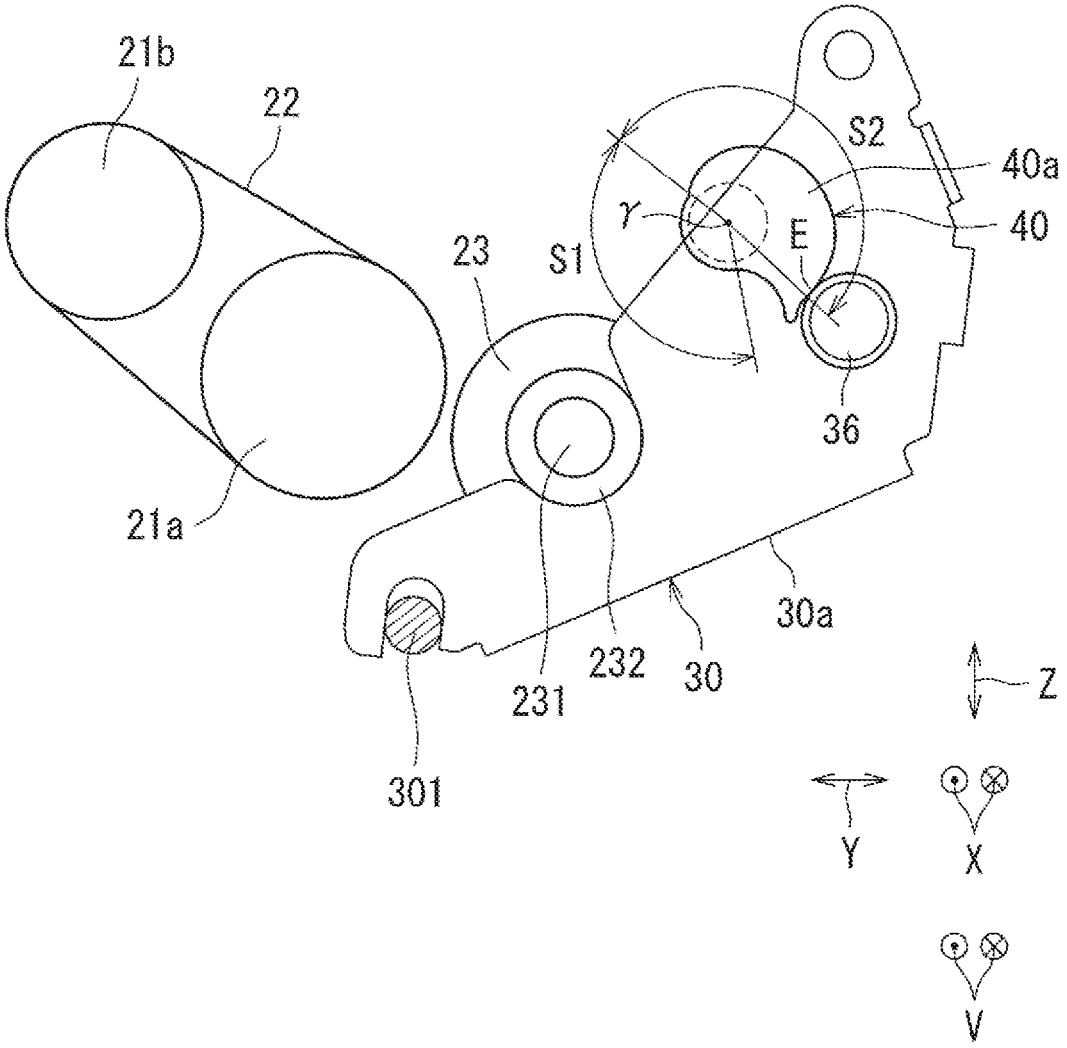
FIG. 10 is a schematic front view illustrating a part of a configuration of the fixing device in a state in which the pressure roller is separated from the fixing belt.
Figure 11:
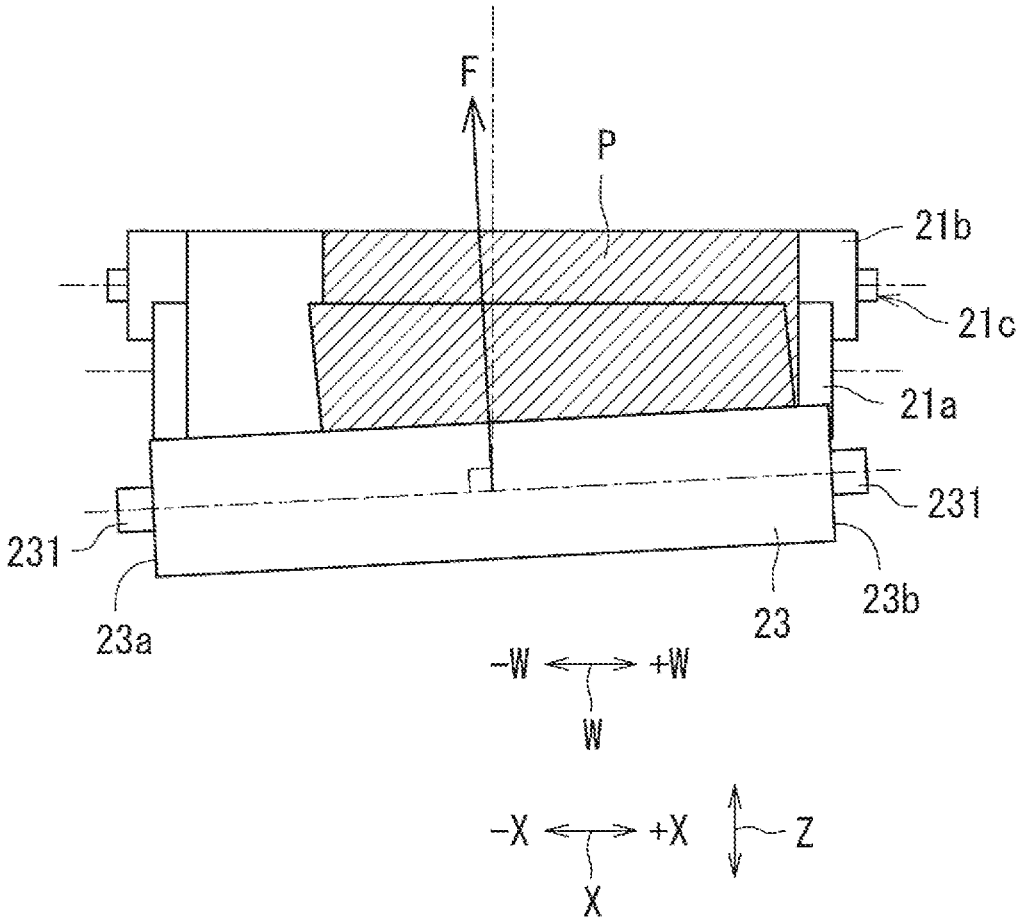
FIG. 11 is a side view schematically illustrating a state in which the pressure roller is inclined to the fixing belt.

FIG. 5 is a schematic front view illustrating a configuration of the pressure roller swinger 60 in a state in which the pressure roller 23 presses against the fixing belt 22 in a neutral position. FIG. 6 is a perspective view illustrating a part of a configuration of a cam shaft 40. FIG. 7 is a schematic diagram of a first cam 41 viewed from the rotation axis direction V of the cam shaft 40. FIG. 8 is a schematic diagram of a second cam viewed from the rotation axis direction V of the cam shaft 40. FIG. 9A is a schematic diagram illustrating positional relationship between the cam shaft 40 and the pressure frame 30 in a case where an abutting position of the first cam 41 and a stopper 36 is a position S, FIG. 9B is a schematic diagram illustrating positional relationship between the cam shaft 40 and the pressure frame 30 in a case where an abutting position of the first cam and the stopper is a position St, FIG. 9C is a schematic diagram illustrating positional relationship between the cam shaft 40 and the pressure frame 30 in a case where an abutting position of the first cam 41 and the stopper 36 is a position Sb, and FIG. 9D is a schematic diagram illustrating positional relationship between the cam shaft 40 and the pressure frame 30 in a case where an abutting position of the first cam 41 and the stopper 36 is a position E. FIG. 10 is a schematic front view illustrating a part of a configuration of the fixing device 200 in a state in which the pressure roller 23 is separated from the fixing belt 22. FIG. 11 is a side view schematically illustrating a state in which the pressure roller 23 is inclined to the fixing belt 22. FIG. 11 is only a schematic diagram for explaining the pressing direction of the pressure roller 23, and does not represent the actual amount of inclination of the pressure roller 23. In FIG. 5 to FIG. 10, a reference character V indicates the rotation axis direction of the cam shaft 40, in which the −V direction (minus V direction) is defined as the axis front direction and the +V direction (plus V direction) is defined as the axis rear direction. In this embodiment, the V direction is along the X direction.

The pressure roller swinger 60 swings one end side (−X direction end side) of the pressure roller 23 in the direction intersecting with the longitudinal direction of the fixing nip area N (which is along the W direction in this embodiment). In this embodiment, the pressure roller swinger 60 includes a pressure frames 30 (30*a*, 30*b*) and the cam shaft 40 (see FIG. 4 and FIG. 5). Specifically, the pressure roller swinger 60 changes a relative position of the pressure frame 30*a* to the pressure frame 30*b* by rotation of the cam shaft 40, moves an end 23*a* on the −X direction side of the pressure roller 23 in the Z direction relative to an end 23*b* on the +X direction side of the pressure roller 23, and swings in the direction intersecting with the longitudinal direction of the fixing nip area N.

The pair of front and rear pressure frames 30 (the pressure frame 30*a* on the −X direction side and the pressure frame 30*b* on the +X direction side) each have a cam shaft receiving portion 31, a cam shaft retracting portion 32, a pressure roller receiving portion 33, a biasing member locking portion 34, a support shaft engaging portion 35, and the stopper 36 (see FIG. 4 and FIG. 5).

The pressure frames 30*a* and 30*b* support the rotating shaft 231 protruding from the both ends 23*a* and 23*b* in the X direction of the pressure roller 23 toward the outside via the respective bearings 232, and are provided in a rotatable state with rotating support shafts 301 as rotating fulcrums (see FIG. 4 and FIG. 5). The pressure frames 30 are each formed from a metal plate such as galvanized steel sheet.

Each cam shaft receiving portion 31 is a portion that receives a second cam 42 of the cam shaft 40, which will be described later, during rotation of the cam shaft 40. The cam shaft receiving portion 31 is formed in a substantially U-shape with an opening in the −Y direction side/Z direction side and has a first abutting portion 311, a curved portion 312, and a second abutting portion 313 (see FIG. 5). The first abutting portion 311 and the second abutting portion 313 are arranged side by side with an opening width D1 that is slightly larger than the diameter of the second cam 42 (see FIG. 9A).

Each cam shaft retracting portion 32 is a portion for retracting the second cam 42 during the rotation of the cam shaft 40. The cam shaft retracting portion 32 is connected to the cam shaft receiving portion 31 and an edge 302 on −Y direction side/Z direction side of the pressure frame 30, and has an opening width D2 that is set larger than the opening width D1 (see FIG. 9A).

Each pressure roller receiving portion 33 is a portion that abuts on the bearing 232 of the rotating shaft 231 of the pressure roller 23, and is recessed in the −Y direction side of the cam shaft receiving portion 31 at the edge 302 of the pressure frame 30 (see FIG. 5).

Each stopper 36 is a portion of the cam shaft 40 that abuts on the first cam 41, and is disposed in predetermined positional relationship with the cam shaft receiving portion 31.

One of the biasing members 90 is locked to the biasing member locking portion 34 (see FIG. 4 and FIG. 5). The other of the biasing member 90 is locked to the fixing frame (not illustrated). The biasing member locking portion 34 is provided at an end on the +Z direction side of the pressure frame 30.

The support shaft engaging portion 35 is a portion with which the rotating support shaft 301 is engaged, and is recessed into the edge 303 on the −Z direction side of the pressure frame 30 (see FIG. 5).

The cam shaft 40 has a pair of the first cams 41 (41*a*, 41*b*), the second cams 42, and a shaft 43 connecting the first cams 41 and the second cams 42 (see FIG. 4 and FIG. 6). The first cams 41 (41*a*, 41*b*) abut on the pressure frames 30 by biasing force of the biasing members 90. The cam shaft 40 is rotationally driven around a cam shaft rotation center δ with the rotation axis direction as the V direction by a cam driving unit 79 described below.

The first cams 41 are provided at ends of the cam shaft 40 (see FIG. 4 and FIG. 6). The first cam 41*a* is provided at the end on the −V direction side of the cam shaft 40, and the first cam 41*b* is provided at the end on the +V direction side of the cam shaft 40 (see FIG. 4).

The first cam 41 is divided into an area S1 (pressing area) and an area S2 (separation movement area) in accordance with the behavior of the pressure roller 23 during the rotation of the cam shaft 40 (see FIG. 7).

The area S1 is formed such that a distance from the cam shaft rotation center δ is a constant value Ls (see FIG. 7). The position S, the position St and the position Sb are provided in the area S1. The position S is located in the middle of the position St and the position Sb. When the first cam 41 and the stopper 36 abut on each other at the position S, the pressure roller 23 presses against the fixing belt 22 at the neutral position with respect to the fixing belt 22. When the first cam 41 and the stopper 36 abut on each other at the position St, the pressure roller 23 presses against the fixing belt 22 such that the fixing belt 22 is fed in the F direction inclined toward the −X direction, as described below. When the first cam 41 and the stopper 36 abut on each other at the position Sb, the pressure roller 23 presses against the fixing belt 22 such that the fixing belt 22 is fed in the F direction inclined toward the +X direction, as described below.

The area S2 is formed such that the distance from the cam shaft rotation center δ gradually moves away from Ls to Le (see FIG. 7). In area S2, when the first cam 41 is rotated in the R2 direction of FIG. 7, the abutting position of the first cam 41 and the stopper 36 reaches the position E (see FIG. 9D and FIG. 10). At this time, as described later, the pressure frame 30 is pushed away from the fixing belt 22 with the position E as the fulcrum by the first cam 41, and the pressure roller 23 and the fixing belt 22 are separated from each other.

The second cam 42 is an eccentric cam whose center ε is offset from the cam shaft rotation center δ by of, and is provided inside the first cam 41*a* (see FIG. 6 and FIG. 8). The second cam 42 is eccentric along a radial line U passing through the cam shaft rotation center δ from the position S of the first cam 41 in the direction away from the position S by a predetermined amount (of) (see FIG. 8). The diameter of the second cam 42 is set to be smaller than the diameter of the shaft 43.

The second cam 42 moves inside the cam shaft receiving portion 31 or retracts to the cam shaft retracting portion 32 in accordance with the abutting position of the first cam 41 and the stopper 36.

Now, the relationship between the second cam 42 and the pressure roller 23 in the pressing direction according to the abutting position of the first cam 41 and the stopper 36 will be described.

As illustrated in FIG. 9A, when the abutting position of the first cam 41 and the stopper 36 is at position S in the area S1, the pressure roller 23 presses against the fixing belt 22 at the neutral position with respect to the fixing belt 22, as described above. At this time, the pressure roller 23 is held in substantially parallel to the fixing belt 22. At this time, the second cam 42 is located between the first abutting portion 311 and the second abutting portion 313 of the cam shaft receiving portion 31. In addition, at this time, the center ε of the second cam 42 is located on a radial line Ua passing through the cam shaft rotation center δ from the abutting position of the first cam 41 and the stopper 36.

As illustrated in FIG. 9B, when the abutting position between the first cam 41 and the stopper 36 is at the position St in the area S1, the center ε of the second cam 42 is located below the radial line Ub passing through the cam shaft rotation center δ from the position St which is the abutting position of the first cam 41 and the stopper 36. At this time, the second cam 42 abuts on the second abutting portion 313 of the cam shaft receiving portion 31. The cam shaft 40 pushes the pressure frame 30*a* down in the −Z direction with the abutting position of the first cam 41 and the stopper 36 as a pivot. The relative position of the pressure frame 30*a* in the Z direction relative to the pressure frame 30*b* changes in the −Z direction. so that the end 23*a* of the pressure roller 23 supported by the pressure frame 30*a* is moved in the −Z direction relative to the end 23*b* of the pressure roller 23 supported by the pressure frame 30*b*, and therefore the pressure roller 23 presses against the fixing belt 22 such that the fixing belt is fed in the F direction inclined toward the −X direction (See FIG. 11). The amount of inclination of the pressure roller 23 is, for example, about ±0.5 mm (inclination angle:±0.09 degrees) for an A4 vertical size configuration (specifically, about 300 mm), but is not of course limited to this.

As illustrated in FIG. 9C, when the abutting position between the first cam 41 and the stopper 36 is at the position Sb in the area S1, the center ε of the second cam 42 is located above the radial line Uc passing through the cam shaft rotation center δ from the position Sb which is the abutting position of the first cam 41 and the stopper 36. At this time, the second cam 42 abuts on the first abutting portion 311 of the cam shaft receiving portion 31. The cam shaft 40 pushes the pressure frame 30*a* up in the +Z direction with the abutting position of the first cam 41 and the stopper 36 as a pivot. The relative position of the pressure frame 30*a* in the Z direction relative to the pressure frame 30*b* changes in the +Z direction, so that the end 23*a* of the pressure roller 23 supported by the pressure frame 30*a* is moved in the +Z direction relative to the end 23*b* of the pressure roller 23 supported by the pressure frame 30*b*, and therefore the pressure roller 23 presses against the fixing belt 22 such that the fixing belt 22 is fed in the direction inclined toward the +X direction.

As illustrated in FIG. 9D, when the abutting position between the first cam 41 and the stopper 36 is in the area S2, the pressure frame 30 is pushed away in the direction away from the fixing belt 22 by the first cam 41, and therefore the pressure roller 23 is separated from the fixing belt 22. At this time, the second cam 42 is retracted to the cam shaft retracting portion 32.

<Controller>

Figure 12:
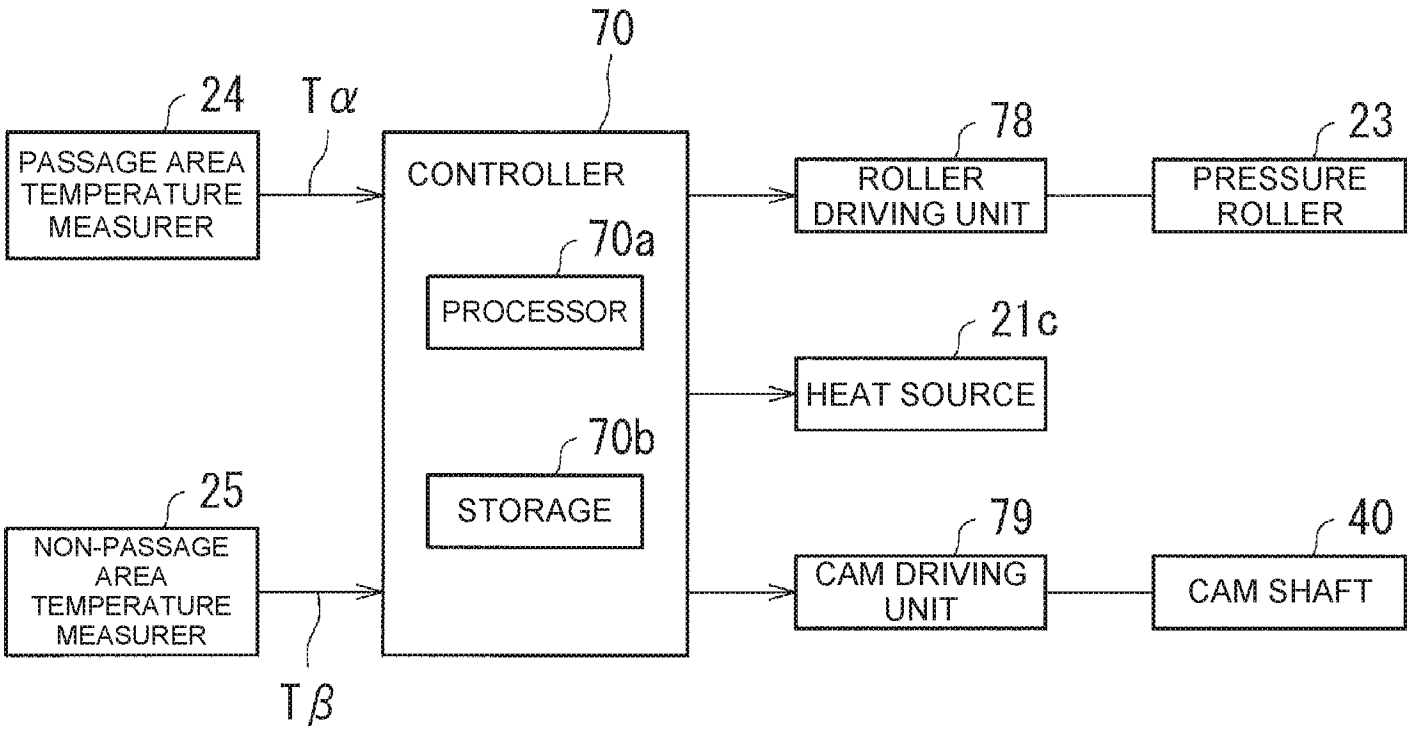
FIG. 12 is a schematic block diagram illustrating a control configuration for controlling operation of the fixing device.
Figure 13:
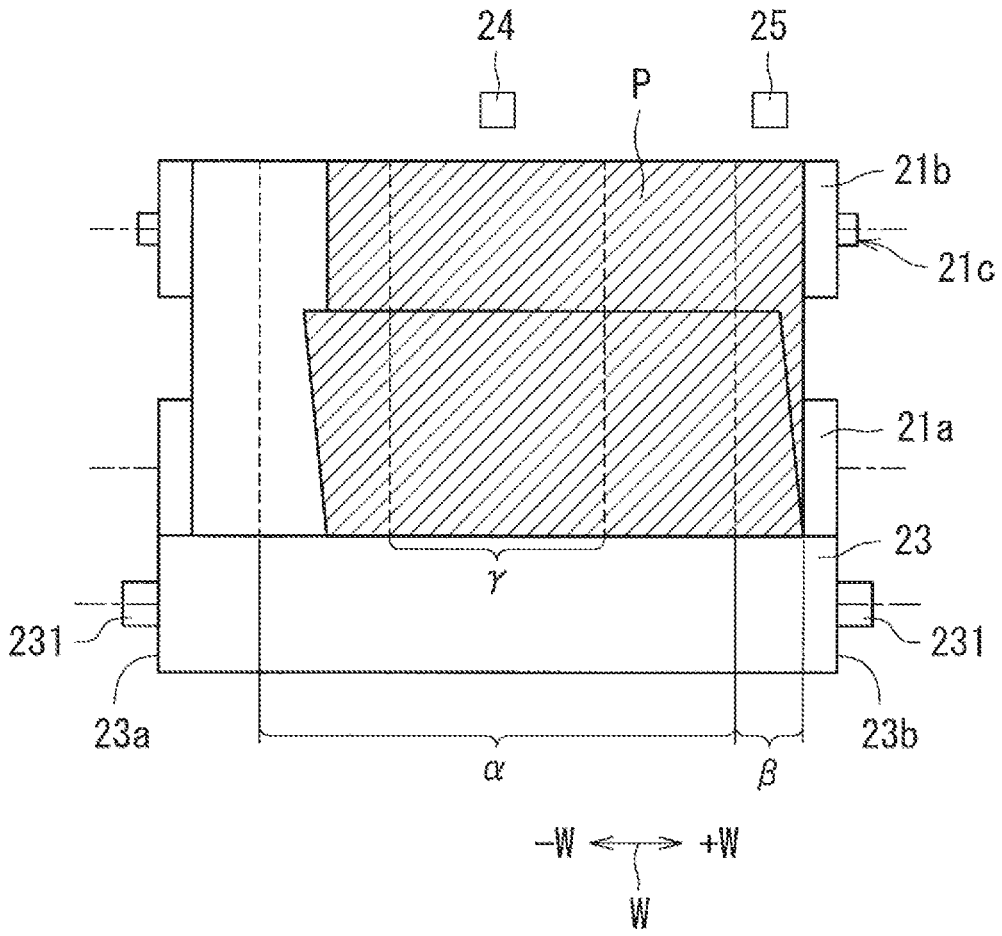
FIG. 13 is a plan view schematically illustrating a state in which a sheet is wound around the fixing belt in a sheet passage area and a sheet non-passage area of the fixing belt.
Figure 14:
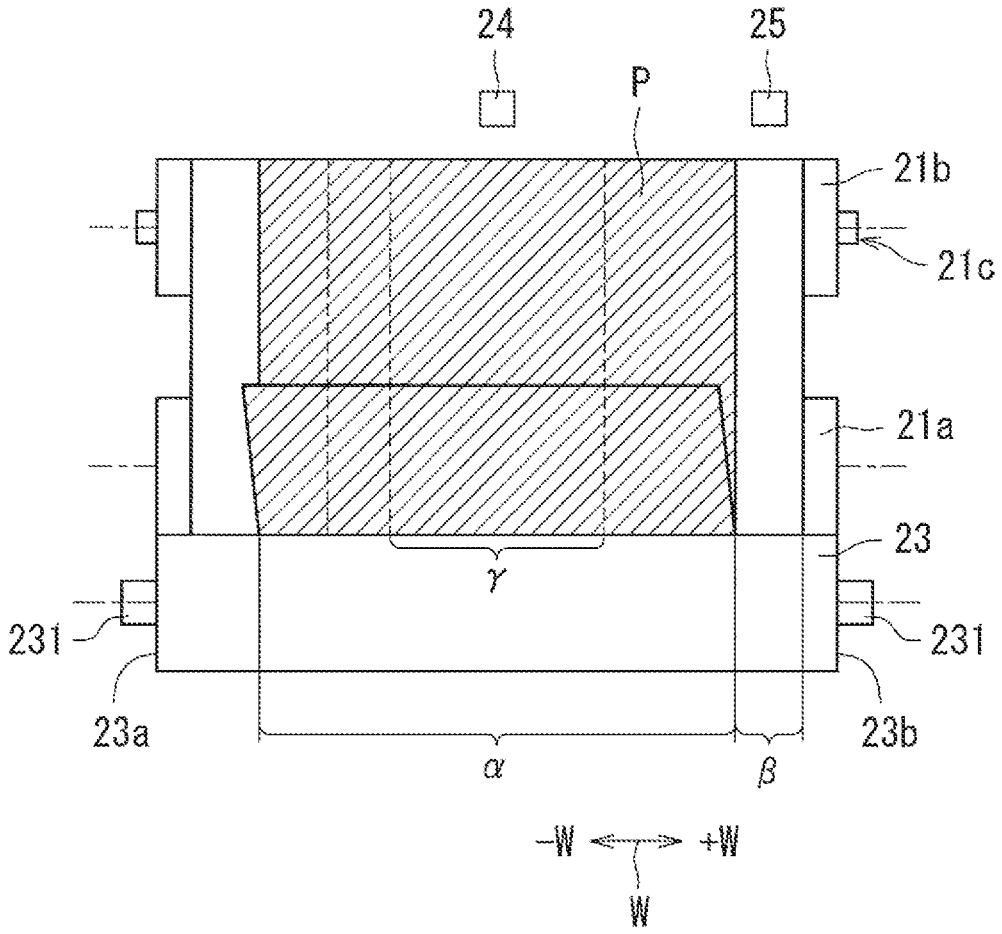
FIG. 14 is a plan view schematically illustrating a state in which a sheet is wound around the fixing belt in the sheet passage area of the fixing belt.

FIG. 12 is a schematic block diagram illustrating a control configuration for controlling operation of the fixing device 200. FIG. 13 is a plan view schematically illustrating a state in which the sheet P is wound around the fixing belt 22 in the sheet passage area a and the sheet non-passage area 13 of the fixing belt 22. FIG. 14 is a plan view schematically illustrating a state in which the sheet P is wound around the fixing belt 22 in the sheet passage area α of the fixing belt 22.

The controller 70 performs meandering correction control for correcting the movement direction of the fixing belt 22 by causing the pressure roller swinger 60 to swing the pressure roller 23, and has a processor 70*a* composed of a computer such as a CPU (Central Processing Unit), and a storage 70*b* including a non-volatile memory such as a ROM (Read Only Memory) and a volatile memory such as a RAM (Random Access Memory) (see FIG. 12). The passage area temperature measurer 24 and the non-passage area temperature measurer 25 are electrically connected to an input system of the controller 70 (see FIG. 12). The heat source 21*c*, the roller driving unit 78 that drives the pressure roller 23, the cam driving unit 79 that rotationally drives the cam shaft 40 of the pressure roller swinger 60 are electrically connected to an output system of the controller 70 (see FIG. 12).

When a control program previously stored in the ROM of the storage section 70*b* is called by the processor 70*a* and loaded on the RAM of the storage 70*b*, control of the operation of the above various components is executed. For example, the heating operation of the heat source 21*c* is performed by the processor 70*a* in accordance with the control program on the basis of temperature information obtained from the non-passage area temperature measurer 25 and the passage area temperature measurer 24.

The meander correction control by the controller 70 is executed as follows. The processor 70*a* of the controller 70 rotationally drives the cam driving unit 79 to rotate the cam shaft 40 until the abutting position of the first cam 41 of the pressure roller swinger 60 and the stopper 36 becomes the position St, the position S or the position Sb as appropriate. The rotation of the cam shaft 40 causes the pressure roller 23 to swing with respect to the fixing belt 22. The direction of the force that the fixing belt 22 receives from the pressure roller 23 changes due to the swing of the pressure roller 23, so that the movement direction (leaning direction) of the fixing belt 22 against which the pressure roller 23 presses is corrected.

Specifically, in a case where the abutting position of the first cam 41 of the pressure roller swinger 60 and the stopper 36 is at the position St (see FIG. 9B), the pressure roller 23 presses against the fixing belt 22 so as to feed the fixing belt 22 in the F direction which is inclined toward the −X direction, as described above (See FIG. 11), and therefore the fixing belt 22 receives force in the −X direction, namely, −W direction from the pressure roller 23, and the movement direction of the fixing belt 22 is corrected to the −W direction. On the other hand, in a case where the abutting position of the first cam 41 of the pressure roller swinger 60 and the stopper 36 is at the position Sb (see FIG. 9C), the pressure roller 23 is inclined toward the +X direction side and presses against the fixing belt 22 as described above, and therefore the fixing belt 22 receives force in the +X direction, namely, +W direction, from the pressure roller 23, and the movement direction of the fixing belt 22 is corrected to the +W direction.

In the fixing device 200, the sheet P that is sandwiched and conveyed between the pressure roller 23 and the fixing belt 22 is usually separated from the fixing belt 22 by a separation member 95 (see FIG. 2). The separation member 95 is provided, so that the sheet winding of the sheet P onto the fixing belt 22 is difficult to occur. However, the sheet P may not be separated from the fixing belt 22 to cause the sheet winding (see FIG. 13 and FIG. 14). In a case where the sheet winding of the sheet P occurs in the sheet non-passage area ß (see FIG. 13), normal temperature measurement in the sheet non-passage area ß is prevented. Therefore, it is desired to remove the sheet P from the sheet non-passage area ß. The fixing belt 22 is moved in the direction away from the non-passage area temperature measurer 25 that measures the temperature of the sheet non-passage area ß, so that it is possible to achieve the movement of the sheet P on the fixing belt 22 in the direction away from the sheet non-passage area ß. Therefore, the controller 70 has such a movement mode as to cause the pressure roller swinger 60 to forcibly move the fixing belt 22 in the direction away from the non-passage area temperature measurer 25 while rotating the fixing belt 22. The movement mode is performed in the following procedure.

First, the processor 70*a* of the controller 70 rotationally drives the cam driving unit 79, and rotates the cam shaft 40 until the abutting position of the first cam 41 and the stopper 36 becomes the position St. In a case where the abutting position of the first cam 41 and the stopper 36 is the position St, as described above, the pressure roller 23 presses against the fixing belt 22 so as to feed the fixing belt 22 in the F direction which is inclined toward the −X direction, and the fixing belt 22 is moved in the −W direction, namely, the direction away from the non-passage area temperature measurer 25. By such a movement mode, the sheet P on the fixing belt 22 is eliminated from the sheet non-passage area ß with the movement of the fixing belt 22 in the −W direction, and therefore the temperature of the non-passage area can be measured more reliably, and whether or not the sheet winding of the sheet onto the fixing belt has occurred can be determined with higher accuracy on the basis of the temperature in the non-passage area. After the execution of the above movement mode, the processor 70*a* of the controller 70 may rotationally drive the cam driving unit 79 to rotate the cam shaft 40 in the direction R1 until the abutting position of the first cam 41 and the stopper 36 becomes the position S, and the pressure roller 23 may be moved to the neutral position side with respect to the fixing belt 22.

In this embodiment, the controller 70 executes the above movement mode during return operation from a sheet jam. The "sheet jam" refers to a state in which the normal conveyance of a sheet is obstructed due to some effects (for example, the sheet P is caught by other parts in a conveyance path) during the image forming operation of the image forming apparatus 100. In a case where a jam occurs, the image forming operation is interrupted, and an opportunity to remove the sheet P from the conveyance path is given to a user. The "return operation from a sheet jam" refers to transition from a state in which the image forming operation is interrupted by a jam to a normal image forming operation. The controller 70 executes the movement mode during the return operation from the sheet jam, so that even in a case where the sheet P is not suitably removed from the fixing belt 22 by the user after the sheet jam occurs, the sheet P remaining on the fixing belt 22 can be moved in the direction away from the non-passage area to measure the temperature of the sheet non-passage area ß.

In this embodiment, the above movement mode is executed while the fixing belt 22 is rotated by a predetermined distance, for example, while the fixing belt 22 is rotated for one rotation. Consequently, it is possible to eliminate the sheet P from the sheet non-passage area ß with high accuracy.

In this embodiment, the controller 70 determines whether or not sheet winding of the sheet P onto the fixing belt 22 occurs. In this embodiment, the controller 70 causes the heat source 21*c* to generate heat during the execution of the movement mode, and after a predetermined time elapses, the controller 70 determines whether or not the sheet winding of the sheet P onto the fixing belt 22 occurs, on the basis of the temperature of the sheet non-passage area ß measured by the non-passage area temperature measurer 25 and the temperature of the sheet passage area a measured by the passage area temperature measurer 24. The determination as to whether or not the sheet winding occurs is performed in the following procedure.

First, the processor 70*a* of the controller 70 starts execution of the movement mode as described above. Next, the processor 70*a* causes the heat source 21*c* to generate heat. The processor 70*a* acquires information on the temperature Ta of the sheet passage area α from the passage area temperature measurer 24, and also acquires information on the temperature Tß of the sheet non-passage area ß from the non-passage area temperature measurer 25. At this time, as illustrated in FIG. 3, in a case where the sheet winding of the sheet P onto the fixing belt 22 does not occur, both the non-passage area temperature measurer 25 and the passage area temperature measurer 24 measure the actual temperature of the surface of the fixing belt 22, and therefore the temperature Ta and the temperature Tß are approximated. However, as illustrated in FIG. 14, in a case where the sheet winding of the sheet P onto the fixing belt 22 occurs in the sheet passage area α, the non-passage area temperature measurer 25 measures the actual temperature of the surface of the fixing belt 22, while the passage area temperature measurer 24 measures the actual temperature of the surface of the sheet P. Heat is transferred from the surface of the fixing belt 22 to the sheet P. Due to the heat loss during this heat transfer, the temperature of the surface of the sheet P is necessarily lower than that of the surface of the fixing belt 22. As illustrated in FIG. 14, in a case where the sheet winding of sheet P onto the fixing belt 22 occurs, the difference between the temperature Ta and the temperature Tß becomes significant.

Therefore, in a case where the difference between the temperature Tα and the temperature Tß is less than a predetermined value, the processor 70*a* determines that the sheet winding of the sheet P onto the fixing belt 22 does not occur. In a case where the difference between the temperature Tα and the temperature Tß is equal to or greater than the predetermined value, the processor 70*a* determines that the sheet winding of the sheet P onto the fixing belt 22 occurs. The above procedure makes it possible to determine whether or not the sheet winding of the sheet P onto the fixing belt 22 occurs.

In this embodiment, when the controller 70 determines that the sheet winding has occurred, the controller 70 stops the heat generation of the heat source 21*c* and the rotation of the fixing belt 22. Consequently, the fixing belt 22 is prevented from continuing to be heated beyond the target temperature (fixing temperature) by the heat source 21*c*, resulting in the effect of avoiding a failure of the fixing device caused by overheating of the fixing belt 22.

Embodiment 2

In Embodiment 2, a controller 70 causes a heat source 21*c* to generate heat during the execution of a movement mode, and in a case where the temperature of a sheet non-passage area ß measured by a non-passage area temperature measurer 25 does not rise by the predetermined value or more for a predetermined time, the controller 70 determines that sheet winding of a sheet P onto a fixing belt 22 occurs. The determination as to whether or not the sheet winding occurs in this embodiment is performed in the following procedure.

First, a processor 70*a* of the controller 70 starts execution of a movement mode as described in Embodiment 1. Next, the processor 70*a* acquires information on the temperature Tß of the sheet non-passage area ß from the non-passage area temperature measurer 25, and stores the information in the storage 70*b*. Then, the processor 70*a* causes the heat source 21*c* to generate heat. The processor 70*a* acquires information on the temperature Tß of the sheet non-passage area ß from the non-passage area temperature measurer 25 again, and compares this information on the temperature Tß with the temperature information stored in the storage 70*b*. At this time, as illustrated in FIG. 3, in a case where the sheet winding of the sheet P onto the fixing belt 22 does not occur, the temperature measurement by the non-passage area temperature measurer 25 is not obstructed by the sheet P, and therefore the temperature Tß of the sheet non-passage area ß measured by the non-passage area temperature measurer 25 rises by the predetermined value or more after the heating by the heat source 21*c*. However, in a case where the sheet winding of the sheet P onto the fixing belt 22 occurs in the sheet passage area a and the sheet non-passage area ß as illustrated in FIG. 13, the temperature measurement by the non-passage area temperature measurer 25 is obstructed by the sheet P, and therefore the temperatures Tß of the sheet non-passage area ß measured by the non-passage area temperature measurer 25 before and after the heat generation by the heat source 21*c* approximate each other. Such a procedure enables the occurrence of the sheet winding of the sheet P onto the fixing belt 22 to be determined in a backup manner, even in a case where the sheet P remains in the sheet non-passage area ß during the execution of the movement mode.

Embodiment 3

Figure 15:
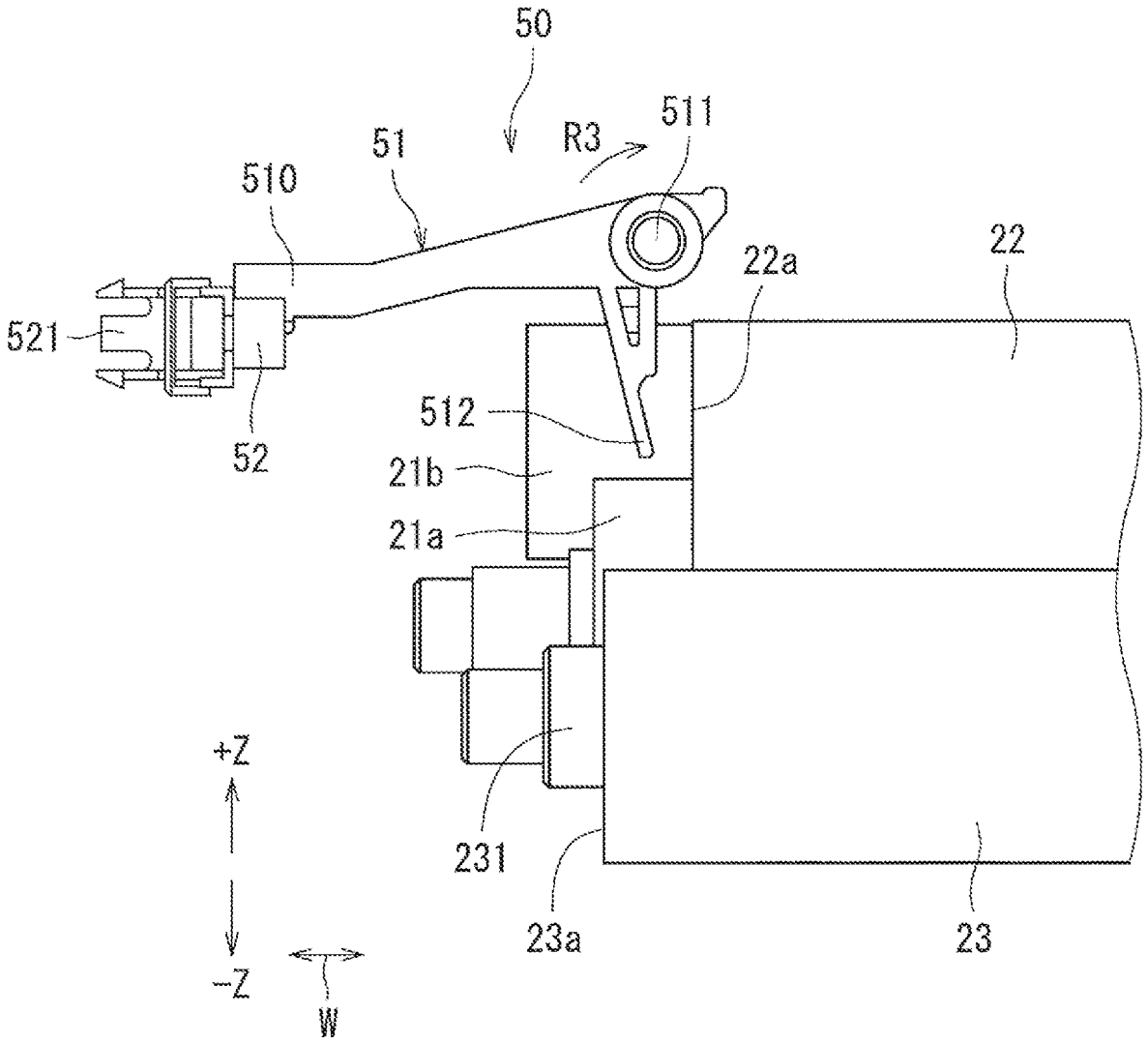
FIG. 15 is a schematic side view illustrating a state of a belt edge detector in a case where an edge of the fixing belt does not reach a predetermined contact position in the −W direction.
Figure 16:
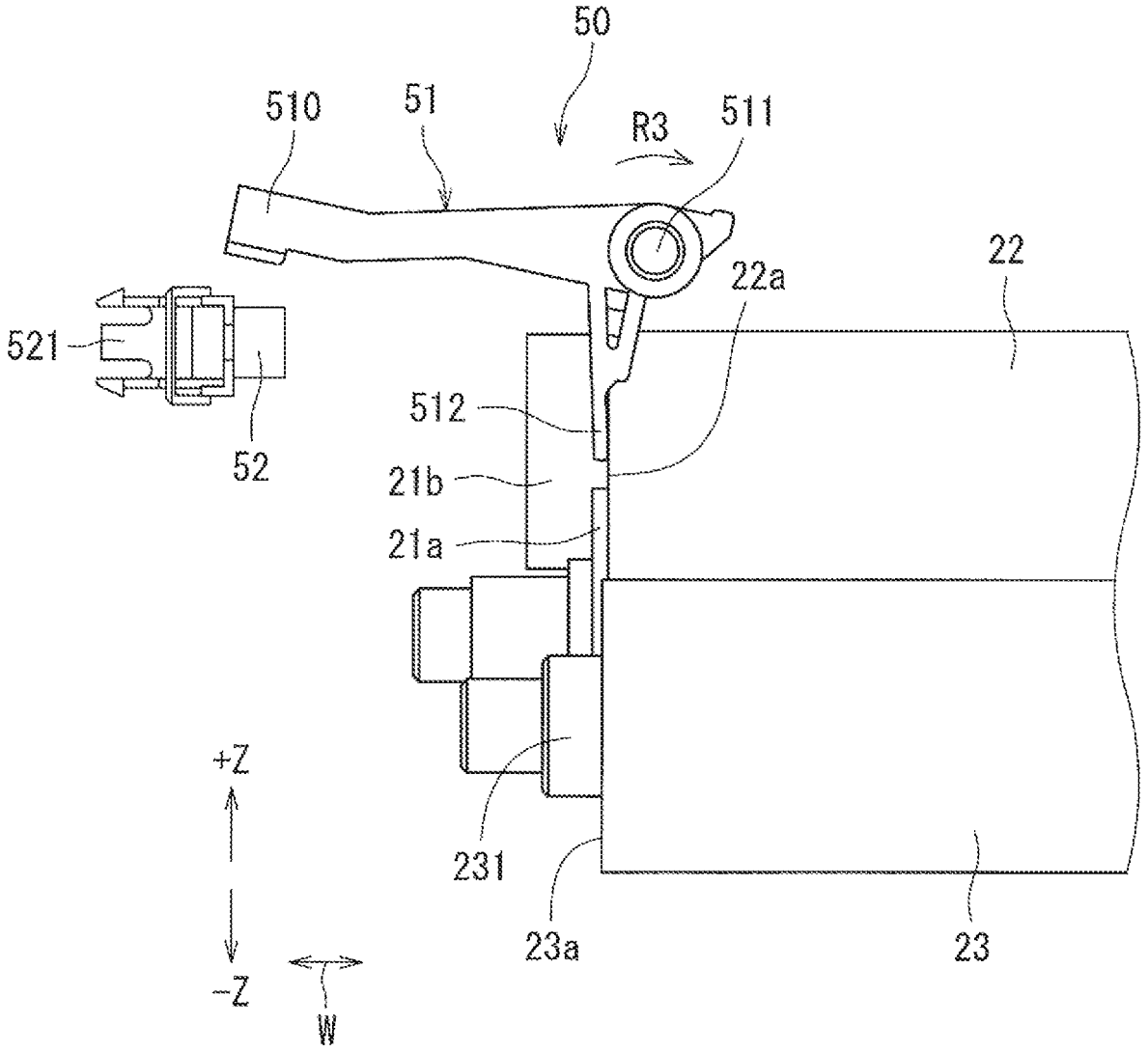
FIG. 16 is a schematic side view illustrating a state of the belt edge detector in a case where the edge of the fixing belt reaches the predetermined contact position in the −W direction.

FIG. 15 is a schematic side view illustrating a state of a belt edge detector 50 in a case where an edge 22*a* on the −W direction side of a fixing belt 22 does not reach a predetermined contact position in the −W direction. FIG. 16 is a schematic side view illustrating a state of the belt edge detector 50 in a case where the edge 22*a* of the fixing belt 22 reaches the predetermined contact position in the −W direction.

A fixing device 200 in Embodiment 3 further has the belt edge detector 50 in addition to the fixing device 200 in the above Embodiment 1.

—Belt Edge Detector—

The belt edge detector 50 has a belt contact portion 51 and a detection sensor 52 (see FIG. 15 and FIG. 16). The belt edge detector 50 is provided on the −W direction side of the fixing belt 22, and has a role of detecting the edge 22*a* of the fixing belt 22 on the −W direction side at a predetermined detection position.

The belt contact portion 51 has a blocking arm 510, a support shaft 511, and a contact claw 512 (see FIG. 15 and FIG. 16).

The blocking arm 510 is a portion that blocks light reception of the detection sensor 52 in contact with the detection sensor 52, which will be described later, and is extended from a support shaft 511 in the −W direction in the form of an arm.

The support shaft 511 is a portion that serves as a rotation support shaft of the belt contact portion 51, and is attached to a housing (not illustrated) of the fixing device 200.

The contact claw 512 is a portion that contacts the end edge 22*a* of the fixing belt 22 at the predetermined contact position, and is extended in the −Z direction from the support shaft 511.

The weight balance of the blocking arm 510 and the contact claw 512 is set such that the blocking arm 510 blocks the light reception of the detection sensor 52 in a state in which the belt contact portion 51 is separated from the fixing belt 22, namely, in a no-load state.

The detection sensor 52 is, for example, a transmissive photointerrupter, and is a sensor that determines the presence or absence of the blocking arm 510 by detecting the blocking of light emitted from a light emitter by a light receiver. The edge 22*a* is detected by the belt edge detector 50 on the basis of signal output of the detection sensor 52. The detection sensor 52 is fixed to a fixing frame (not illustrated) by a locking portion 521.

The edge 22*a* of the fixing belt 22 is detected by the belt edge detector 50 as follows.

When the edge 22*a* of the fixing belt 22 does not reach the predetermined contact position in the −W direction, the edge 22*a* and the contact claw 512 are separated from each other (see FIG. 15). The blocking arm 510 is in contact with the detection sensor 52 and blocks the light reception of the detection sensor 52. The detection sensor 52 determines that the blocking arm 510 is present, by the blocking of the light reception of the detection sensor 52. The belt edge detector 50 does not detect the edge 22*a* on the basis of an output signal of the detection sensor 52 at this time.

On the other hand, when the edge 22*a* of the fixing belt 22 reaches the predetermined contact position in the −W direction, the edge 22*a* is in contact with the contact claw 512. The further displacement of the fixing belt 22 in the −W direction causes the contact claw 512 to move in the −W direction, and causes the belt edge detector 50 to rotate in the R3 direction (see FIGS. 15 and 16). With the rotation of the belt edge detector 50, the blocking arm 510 is separated from the detection sensor 52, and does not block the light reception of the detection sensor 52 (see FIG. 16). The position of the edge 22*a* of the fixing belt 22 at this time is referred to as the "predetermined detection position". The detection sensor 52 determines that the blocking arm 510 is not present by the light reception of the detection sensor 52. The belt edge detector 50 detects the edge 22*a* on the basis of an output signal of the detection sensor 52 at this time.

A controller 70 in embodiment 3 controls a pressure roller swinger 60 on the basis of the detection result of the belt edge detector 50. For example, in a case where the belt edge detector 50 detects the edge 22*a* of the fixing belt 22, a processor 70*a* of the controller 70 rotationally drives a cam driving unit 79 to rotate a cam shaft 40 in the R1 direction of FIG. 7 until the abutting position of the first cam 41 and the stopper 36 becomes the position Sb. When the cam shaft 40 is rotated in this manner, a pressure roller 23 presses against the fixing belt 22 so as to feed the fixing belt 22 in the direction inclined toward the +X direction, as described above. In other words, when the edge 22*a* of the fixing belt 22 reaches the predetermined detection position, the processor 70*a* of the controller 70 controls the pressure roller swinger 60 such that the movement direction of the fixing belt 22 becomes the +W direction. On the other hand, in a case where the belt edge detector 50 no longer detects the edge 22*a*, the processor 70*a* of the controller 70 controls the pressure roller swinger 60 such that the movement direction of the fixing belt 22 becomes the −W direction. Consequently, control to make the fixing belt 22 run stably without deviation to either side of the W direction (meandering correction control) is achieved.

In embodiment 3, in a case where the belt edge detector 50 detects the edge of the fixing belt 22 when the controller 70 starts rotating the fixing belt 22, the controller 70 executes the aforementioned movement mode for a predetermined time, and thereafter shifts to the aforementioned meandering correction control. Herein, the predetermined time can be, for example, a rotation time of about one to several rotations of the fixing belt 22. Consequently, it is possible to reliably move the sheet P on the fixing belt 22 in the direction away from the sheet non-passage area ß.

In Embodiment 3, the execution time of the movement mode in a case where the belt edge detector 50 does not detect the edge of the fixing belt 22 is set to be longer than the execution time of the movement mode in a case where the belt edge detector 50 detects the edge of the fixing belt 22. Consequently, it is possible to avoid an overload to the fixing belt 22 and the belt edge detector 50.

The above embodiments are illustrative in all respects and are not intended to be the basis for a limiting interpretation. Therefore, the technical scope of the present invention is not interpreted solely by the embodiments described above, but is defined based on the claims. Furthermore, any changes and modifications within the meaning and range equivalent to the claims fall within the scope of the invention.

What is claimed is:

1. A fixing device comprising:

a rotatable endless fixing belt;

a facing member disposed on an inner side of the fixing belt, the facing member including a contact portion contacting the inner side of the fixing belt;

a pressure roller that presses against the fixing belt toward the facing member from outside to form, between the fixing belt and the pressure roller, a fixing nip area for conveying a sheet formed with a toner image thereon;

a heat source including a heat portion that heats the fixing belt;

a non-passage area temperature measurer including a detection portion that measures a temperature of a sheet non-passage area which corresponds to an area where the sheet is not conveyed in the fixing nip area and is on one end side in a width direction of the fixing belt;

a pressure roller swinger that swings one end side of the pressure roller in a direction intersecting with a longitudinal direction of the fixing nip area; and a controller including a processor that performs meandering correction control for correcting a movement direction of the fixing belt by causing the pressure roller swinger to swing the pressure roller, wherein the controller has a movement mode as to cause the pressure roller swinger to forcibly move the fixing belt in a direction away from the non-passage area temperature measurer while rotating the fixing belt, and the controller executes the movement mode during a return operation from a sheet jam.

2. The fixing device according to claim 1, wherein the movement mode is executed while the fixing belt is rotated by a predetermined distance.

3. The fixing device according to claim 1, further comprising a belt edge detector including a detection portion that detects an edge on the other end side in the width direction of the fixing belt, wherein the controller further controls the pressure roller swinger on the basis of a detection result of the belt edge detector.

4. The fixing device according to claim 3, wherein in a case where the belt edge detector detects the edge of the fixing belt when the controller starts rotating the fixing belt, the controller executes the movement mode for a predetermined time, and thereafter shifts to the meandering correction control.

5. The fixing device according to claim 1, wherein the controller further causes the heat source to generate heat during execution of the movement mode, and in a case where the temperature of the sheet non-passage area measured by the non-passage area temperature measurer does not rise by a predetermined value or more for a predetermined time, the controller determines that sheet winding of a sheet onto the fixing belt has occurred.

6. The fixing device according to claim 5, wherein when the controller determines that the sheet winding has occurred, the controller stops the heat generation of the heat source and the rotation of the fixing belt.

7. The fixing device according to claim 1, further comprising a passage area temperature measurer including a detection portion that measures a temperature of a sheet passage area on the fixing belt, wherein the controller further causes the heat source to generate heat during execution of the movement mode, and after a predetermined time elapses, the controller determines whether or not sheet winding of a sheet onto the fixing belt has occurred, on the basis of the temperature of the sheet non-passage area measured by the non-passage area temperature measurer and the temperature of the sheet passage area measured by the passage area temperature measurer.

8. An image forming apparatus comprising the fixing device according to claim 1.

9. A fixing device comprising:

a rotatable endless fixing belt;

a facing member disposed on an inner side of the fixing belt, the facing member including a contact portion contacting the inner side of the fixing belt;

a pressure roller that presses against the fixing belt toward the facing member from outside to form, between the fixing belt and the pressure roller, a fixing nip area for conveying a sheet formed with a toner image thereon;

a heat source including a heat portion that heats the fixing belt;

a non-passage area temperature measurer including a detection portion that measures a temperature of a sheet non-passage area which corresponds to an area where the sheet is not conveyed in the fixing nip area and is on one end side in a width direction of the fixing belt;

a pressure roller swinger that swings one end side of the pressure roller in a direction intersecting with a longitudinal direction of the fixing nip area; and a controller including a processor that performs meandering correction control for correcting a movement direction of the fixing belt by causing the pressure roller swinger to swing the pressure roller, wherein the fixing device further includes a passage area temperature measurer including a detection portion that measures a temperature of a sheet passage area on the fixing belt, the controller has a movement mode as to cause the pressure roller swinger to forcibly move the fixing belt in a direction away from the non-passage area temperature measurer while rotating the fixing belt, the movement mode is executed while the fixing belt is rotated by a predetermined distance, and the controller causes the heat source to generate heat during execution of the movement mode, and after a predetermined time elapses, the controller determines whether or not sheet winding of a sheet onto the fixing belt has occurred, on the basis of the temperature of the sheet non-passage area measured by the non-passage area temperature measurer and the temperature of the sheet passage area measured by the passage area temperature measurer.

10. The fixing device according to claim 9, further comprising a belt edge detector including a detection portion that detects an edge on the other end side in the width direction of the fixing belt, wherein the controller further controls the pressure roller swinger on the basis of a detection result of the belt edge detector.

11. The fixing device according to claim 10, wherein in a case where the belt edge detector detects the edge of the fixing belt when the controller starts rotating the fixing belt, the controller executes the movement mode for a predetermined time, and thereafter shifts to the meandering correction control.

12. The fixing device according to claim 9, wherein the controller further causes the heat source to generate heat during execution of the movement mode, and in a case where the temperature of the sheet non-passage area measured by the non-passage area temperature measurer does not rise by a predetermined value or more for a predetermined time, the controller determines that sheet winding of a sheet onto the fixing belt has occurred.

13. The fixing device according to claim 12, wherein when the controller determines that the sheet winding has occurred, the controller stops the heat generation of the heat source and the rotation of the fixing belt.

14. An image forming apparatus comprising the fixing device according to claim 9.

15. A fixing device comprising:

a rotatable endless fixing belt;

a facing member disposed on an inner side of the fixing belt, the facing member including a contact portion contacting the inner side of the fixing belt;

a pressure roller that presses against the fixing belt toward the facing member from outside to form, between the fixing belt and the pressure roller, a fixing nip area for conveying a sheet formed with a toner image thereon;

a heat source including a heat portion that heats the fixing belt;

a non-passage area temperature measurer including a detection portion that measures a temperature of a sheet non-passage area which corresponds to an area where the sheet is not conveyed in the fixing nip area and is on one end side in a width direction of the fixing belt;

a pressure roller swinger that swings one end side of the pressure roller in a direction intersecting with a longitudinal direction of the fixing nip area; and a controller including a processor that performs meandering correction control for correcting a movement direction of the fixing belt by causing the pressure roller swinger to swing the pressure roller, wherein the fixing device further includes a belt edge detector including a detection portion that detects an edge on the other end side in the width direction of the fixing belt, the controller has a movement mode as to cause the pressure roller swinger to forcibly move the fixing belt in a direction away from the non-passage area temperature measurer while rotating the fixing belt, the controller further controls the pressure roller swinger on the basis of a detection result of the belt edge detector, and in a case where the belt edge detector detects the edge of the fixing belt when the controller starts rotating the fixing belt, the controller executes the movement mode for a predetermined time, and thereafter shifts to the meandering correction control.

16. The fixing device according to claim 15, wherein the controller further causes the heat source to generate heat during execution of the movement mode, and in a case where the temperature of the sheet non-passage area measured by the non-passage area temperature measurer does not rise by a predetermined value or more for a predetermined time, the controller determines that sheet winding of a sheet onto the fixing belt has occurred.

17. The fixing device according to claim 16, wherein when the controller determines that the sheet winding has occurred, the controller stops the heat generation of the heat source and the rotation of the fixing belt.

18. The fixing device according to claim 15, further comprising a passage area temperature measurer including a detection portion that measures a temperature of a sheet passage area on the fixing belt, wherein the controller further causes the heat source to generate heat during execution of the movement mode, and after a predetermined time elapses, the controller determines whether or not sheet winding of a sheet onto the fixing belt has occurred, on the basis of the temperature of the sheet non-passage area measured by the non-passage area temperature measurer and the temperature of the sheet passage area measured by the passage area temperature measurer.

19. An image forming apparatus comprising the fixing device according to claim 15.

20. The fixing device according to claim 15, wherein the movement mode is executed while the fixing belt is rotated by a predetermined distance.

* * * * *